US007399369B2

(12) United States Patent
Nanba et al.

(10) Patent No.: US 7,399,369 B2
(45) Date of Patent: Jul. 15, 2008

(54) ULTRA-HIGH MAGNETIC FLUX DENSITY GRAIN-ORIENTED ELECTRICAL STEEL SHEET EXCELLENT IN IRON LOSS AT A HIGH MAGNETIC FLUX DENSITY AND FILM PROPERTIES AND METHOD FOR PRODUCING THE SAME

(75) Inventors: Eiichi Nanba, Himeji (JP); Katsuyuki Yanagihara, Futtsu (JP); Satoshi Arai, Himeji (JP); Shuichi Yamazaki, Futtsu (JP); Fumikazu Ando, Himeji (JP); Kazutoshi Takeda, Himeji (JP); Yousuke Kurosaki, Himeji (JP); Nobuo Tachibana, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 663 days.

(21) Appl. No.: 10/484,347

(22) PCT Filed: Jul. 16, 2002

(86) PCT No.: PCT/JP02/07229

§ 371 (c)(1),
(2), (4) Date: Jun. 22, 2004

(87) PCT Pub. No.: WO03/008654

PCT Pub. Date: Jan. 30, 2003

(65) Prior Publication Data

US 2004/0231752 A1 Nov. 25, 2004

(30) Foreign Application Priority Data

Jul. 16, 2001 (JP) ..... 2001-216033
Sep. 14, 2001 (JP) ..... 2001-280365
Sep. 21, 2001 (JP) ..... 2001-289517

(51) Int. Cl.
*H01F 1/147* (2006.01)
*H01F 1/18* (2006.01)

(52) U.S. Cl. ..... 148/308; 148/307; 148/111

(58) Field of Classification Search ..... None
See application file for complete search history.

(56) References Cited

U.S. PATENT DOCUMENTS 6,280,534 B1 * 8/2001 Senda et al. ..... 148/113
2002/0011278 A1 * 1/2002 Komatsubara et al. ..... 148/120

FOREIGN PATENT DOCUMENTS

EP 0588342 3/1994

(Continued)

OTHER PUBLICATIONS

Machine Translation of Japanese Patent Document No. 08-188824 cited in the IDS submitted Jun. 24, 2004.*

*Primary Examiner*—John P. Sheehan
(74) *Attorney, Agent, or Firm*—Kenyon & Kenyon LLP

(57) ABSTRACT

The present invention is a grain-oriented electrical steel sheet characterized in that Bi is present at 0.01 to less than 1,000 ppm in terms of mass at the interface of the substrate steel and the primary film of the grain-oriented electrical steel sheet. The grain-oriented electrical steel sheet is produced by any of the processes of: before decarburization annealing, applying preliminary annealing for 1 to 20 sec. at 700° C. or higher and controlling an atmosphere in the temperature range; controlling the maximum attaining temperature B (° C.) before final cold rolling so that the maximum attaining temperature B may satisfy the expression, $-10\times\ln(A)+1{,}100 \leqq B \leqq 10\times\ln(A)+1{,}220$, in accordance with a Bi content A (ppm) and at the same time heating the steel sheet cold rolled to the final thickness to 700° C. or higher within 10 sec. or at a heating rate of 100° C./sec. or more before decarburization annealing, or immediately thereafter applying preliminary annealing for 1 to 20 sec. at 700° C. or higher; or controlling a $TiO_2$ amount B added in relation to MgO of 100 as parts by weight and an MgO coating amount C ($g/m^2$) so that the expression, $A^{0.8} \leqq B\times C \leqq 400$, may be satisfied in accordance with the Bi content A (ppm).

7 Claims, 5 Drawing Sheets

FOREIGN PATENT DOCUMENTS

| | | | |
|---|---|---|---|
| EP | 0957180 | | 11/1999 |
| EP | 987343 | | 3/2000 |
| EP | 1057898 | | 12/2000 |
| JP | 8-188824 | | 7/1996 |
| JP | 9-279247 | | 10/1997 |
| JP | 10-130726 | | 5/1998 |
| JP | 10-130727 | | 5/1998 |
| JP | 2000-26942 | | 1/2000 |
| JP | 2000-109931 | | 4/2000 |
| JP | 2001-47194 | * | 2/2001 |
| WO | WO 98/46803 | | 10/1998 |

* cited by examiner

ULTRA-HIGH MAGNETIC FLUX DENSITY GRAIN-ORIENTED ELECTRICAL STEEL SHEET EXCELLENT IN IRON LOSS AT A HIGH MAGNETIC FLUX DENSITY AND FILM PROPERTIES AND METHOD FOR PRODUCING THE SAME

TECHNICAL FIELD

The present invention relates to a grain-oriented electrical steel sheet used mainly as the iron core of electrical apparatuses such as transformers and others, and a method for producing the grain-oriented electrical steel sheet. In particular, the present invention provides a grain-oriented electrical steel sheet having an ultra-high magnetic flux density and excellent film properties and excellent in iron loss properties by controlling the heating rate and the atmosphere of decarburization annealing, and a method for producing the grain-oriented electrical steel sheet.

BACKGROUND ART

A grain-oriented electrical steel sheet used as the magnetic iron core for various electric apparatuses generally contains 2 to 7% Si and has a product crystal structure highly accumulated to {110}<001> orientations. The product quality of a grain-oriented electrical steel sheet is evaluated by both iron loss properties and excitation properties. Reduction of iron loss is as a result of reduction of energy loss taken away as thermal energy when a grain-oriented electrical steel sheet is used in an electric apparatus and therefore is desirable from the viewpoint of energy saving.

Meanwhile, the improvement of excitation properties makes it possible to increase the designed magnetic flux density of an electric apparatus and therefore is desirable from the point of view of reducing the size of the apparatus. Since the accumulation of a product crystal structure to {110}<001> orientations is desirable in order to improve the excitation properties and also reduce iron loss, various research has been carried out and various production technologies developed recently.

One of the typical technologies for the improvement of magnetic flux density is the production method disclosed in Japanese Examined Patent Publication No. S40-15644. This is a production method wherein AlN and MnS function as inhibitors and a high reduction ratio exceeding 80% is employed at the final cold rolling process. By this method, a grain-oriented electrical steel sheet having crystal grains accumulated to {110}<001> orientations and having a high magnetic flux density of 1.870 T or more in terms of $B_8$ (a magnetic flux density at 800 A/m) can be obtained.

However, a magnetic flux density $B_8$ obtained by the method is about 1.88 to at most 1.95 T and the value is only about 95% of the saturation magnetic flux density 2.03 T of a 3% silicon steel. Nevertheless, in recent years, the social demand for energy saving and conservation of resources has been growing increasingly severe and the demand for the reduction of iron loss and the improvement of the magnetization properties of a grain-oriented electrical steel sheet has also been increasing. Therefore, further improvement of magnetic flux density is in strong demand.

As a technology for improving magnetic flux density, Japanese Examined Patent Publication No. S58-50295 proposes the temperature gradient annealing method. By this method, a product having not less than 1.95 T in $B_8$ was produced stably for the first time. However, when the method is applied to a coil having a weight on an industrial scale, the method requires heating an end face of the coil and cooling the other end face thereof to create a temperature gradient and causes large thermal energy loss. Therefore, there has been a problem in the application of the method to industrial production.

In this connection, as a technology to improve magnetic flux density, the method wherein Bi of 100 to 500 g/t is added to molten steel is disclosed in Japanese Unexamined Patent Publication No. H6-88171 and a product having $B_8$ of 1.95 T or more has been produced. Further, the method wherein Bi is contained from 0.0005 to 0.05% as a constituent component in a base material and the material is rapidly heated to a temperature range of 700° C. or higher at a heating rate of 100° C./sec. or more before decarburization annealing is disclosed in Japanese Unexamined Patent Publication No. H8-188824, and by this method, it is possible to stabilize secondary recrystallization over the length and width of a coil and to stably obtain $B_8$ of 1.95 T or more at any point in the coil industrially.

It is believed, as disclosed in Japanese Unexamined Patent Publication No. H6-207216 and others, that Bi accelerates the precipitation of fine MnS and AlN functioning as inhibitors, thus raises inhibitor strength, and is advantageous to the selective growth of the crystal grains having little deviation from the ideal {110}<001> orientations.

In particular, it is well known that the precipitation control of AlN functioning as an inhibitor greatly depends on the temperature of hot band annealing or annealing prior to the finish cold-rolling process among a plurality of cold-rolling processes incorporating intermediate annealing in between, and therefore optimization of the temperature has been adopted.

The following methods are employed in the case of a base material containing Bi: the method wherein hot band annealing or annealing prior to the finish cold-rolling process among a plurality of cold-rolling processes incorporating intermediate annealing in between is applied for 30 sec. to 30 min. in a temperature range from 850° C. to 1,100° C. as disclosed in Japanese Unexamined Patent Publication No. H6-212265; the method wherein the temperature of annealing prior to finish cold rolling is controlled in accordance with the excessive amount of Al in steel as disclosed in Japanese Unexamined Patent Publication No. H8-253815; and the method wherein an average cooling rate of a hot band is controlled and a temperature of annealing prior to finish cold rolling is controlled in the range from 2,400×Bi (wt %)+875° C. to 2,400×Bi (wt %)+1,025° C. in accordance with a Bi content as disclosed in Japanese Unexamined Patent Publication No. H11-124627. A feature of all of these methods is that the appropriate temperature range of annealing prior to finish cold rolling is lower than that in the case of not adding Bi.

However, since equipment for annealing prior to finish cold rolling is generally not designed so as to exclusively process Bi contained materials, it has been necessary to change the temperature from a higher temperature for a material not containing Bi when a Bi contained material is processed at a lower temperature, and poor secondary recrystallization or, even when secondary recrystallization occurs, poor magnetic property in terms of low magnetic flux density has sometimes arisen at the temperature change portion. Furthermore, a coil for temperature adjustment is sometimes used in the event of temperature change, but this measure is not desirable, since it reduces productivity.

In the meantime, as methods for reducing iron loss, various methods of magnetic domains refinement are disclosed including: the method wherein laser treatment is applied to a steel sheet disclosed in Japanese Examined Patent Publication No. S57-2252; the method wherein mechanical strain is introduced to a steel sheet disclosed in Japanese Examined Patent Publication No. S58-2569; and other methods. In general, the iron loss of a grain-oriented electrical steel sheet is evaluated by $W_{17/50}$ (energy loss under the excitation conditions of 1.7 T in $B_8$ and 50 Hz) stipulated in JIS C2553 and classified. In recent years, cases where an excitation magnetic flux density is raised to 1.7 T or more in an attempt to downsize a transformer and, even when a magnetic flux density is designed to be 1.7 T, a local magnetic flux density of a transformer iron core is raised to 1.7 T or more, and a steel sheet having a reduced iron loss at a high magnetic flux density ($W_{19/50}$ for example) is desired.

With regard to a grain-oriented electrical steel sheet having a reduced iron loss in a high magnetic flux density, Japanese Unexamined Patent Publication No. 2000-345306 discloses the method wherein the deviation of the crystal orientations of a steel sheet from the ideal {110}<001> orientation is controlled to not more than five degrees on average and the average magnetic domain width of the steel sheet at 180° C. is controlled in the range from over 0.26 to 0.30 mm, or the area percentage of magnetic domains having a magnetic domain width of over 0.4 mm in the steel sheet is controlled in the range from over 3 to 20%. As a method for producing such a grain-oriented electrical steel sheet, Japanese Unexamined Patent Publication No. 2000-345305 discloses the method wherein a steel sheet is heated to 800° C. or higher at a heating rate of 100° C./sec. or more immediately before decarburization annealing. However, the high magnetic field iron loss of a steel sheet produced by the method is 1.13 W/kg in $W_{19/50}$ at the lowest, and thus grain-oriented electrical steel sheet having still lower iron loss at a high magnetic flux density is desired.

In the case where Bi is contained in a base material, as disclosed in Japanese Unexamined Patent Publication Nos. H6-89805 and 2000-26942, the crystal grains of a product coarsen, therefore the magnetic domain width increases, conventional measures for magnetic domains refinement are not sufficient to narrow the magnetic domain width, and consequently there has been room for further decreasing iron loss at high magnetic flux density.

Further, as disclosed in many patent publications, when Bi is contained in a steel, a glass film that functions as an insulating film has not been formed stably in the width direction.

Moreover, as a technology for rapidly heating a steel sheet immediately before decarburization annealing, Japanese Unexamined Patent Publication No. H11-61356 discloses the technology for producing a grain-oriented electrical steel sheet excellent in film adhesiveness and magnetic properties through the processes of: carrying out the heating process in decarburization annealing in a rapid-heating chamber installed next to a decarburization annealing furnace; controlling the ratio $P_{H2O}/P_{H2}$ in the rapid-heating chamber in the range from 0.65 to 3.0; rapidly heating the strip to a temperature of 800° C. or higher at a heating rate of 100° C./sec. or more; controlling the resident time in the temperature range of 750° C. or higher in the rapid-heating chamber to 5 sec. or less; and further processing the strip by controlling the ratio $P_{H2O}/P_{H2}$ in the decarburization annealing furnace in the range from 0.25 to 0.6. Further, Japanese Unexamined Patent Publication No. 2000-204450 discloses the method for producing a grain-oriented electrical steel sheet excellent in film adhesiveness and magnetic properties by heating a steel sheet to 800° C. or higher at a heating rate of 100° C./sec. or more and controlling an oxygen partial pressure and a vapor partial pressure in an atmosphere in the temperature range. However, even by those methods, when Bi is contained in a steel, it is impossible to form a primary film uniformly in a coil.

Further, Japanese Unexamined Patent Publication No. H8-188824 discloses the technology for obtaining a high magnetic flux density uniformly in a coil by: containing 0.0005 to 0.05% Bi in a base material; heating the coil to a temperature range of 700° C. or higher at a heating rate of 100° C./sec. or more in an atmosphere having a ratio $P_{H2O}/P_{H2}$ of 0.4 or less before applying decarburization annealing; thus controlling the amount of $SiO_2$; and stabilizing the behavior of absorbing and disgorging nitrogen in finish annealing. Such heat treatment is applied generally by using an electrical device for induction heating or conduction heating, and therefore it is commonly used to control an $H_2$ concentration to 4% or less from the viewpoint of explosion-protection. Therefore, in order to secure an atmosphere wherein the ratio $P_{H2O}/P_{H2}$ is controlled to 0.4 or less, it is necessary to stabilize operation at a low dew point, and thus a dehumidifier or the like is required, which results in increased equipment cost. In addition, a problem thereof is that the dew point must be controlled so as to deal with the least variation of a hydrogen concentration and therefore flexibility of operation is greatly hampered.

Next, an electrically insulative film formed on the surface of a grain-oriented electrical steel sheet is explained. Such a film plays a role not only of maintaining insulation, but also of imposing a tensile stress on a steel sheet and reducing iron loss by making use of the fact that the coefficient of thermal expansion of the film is lower than that of the steel sheet. Further, a good insulating film is important also in a transformer manufacturing process. In particular, in the case of a wound-core type transformer, bend forming is applied to a grain-oriented electrical steel sheet and therefore a film may sometimes exfoliate. For this reason, a film is also required to have excellent film adhesiveness.

Such an insulating film of a grain-oriented electrical steel sheet is composed of two films; a primary film and a secondary film. A primary film is formed by making $SiO_2$ that is formed on a steel sheet surface in decarburization annealing react to an annealing separator that is applied thereafter in the finish annealing process. In general, an annealing separator is component mainly of MgO and reacts to $SiO_2$ and forms $Mg_2SiO_1$. Finish annealing is generally applied to a steel sheet in the state of a coil and is influenced by temperature deviation in the coil and the distributability of an atmosphere between steel sheet layers. Therefore, a challenge is to form a primary film uniformly, and various methods have tried to solve the problem with regard to a decarburization annealing process, MgO functioning as an annealing separator, finish annealing process conditions and others.

As methods for optimizing an oxide layer formed on the surface of a steel sheet subjected to decarburization annealing, Japanese Unexamined Patent Publication No. H11-323438 discloses the method wherein $P_{H2O}/P_{H2}$ in a soaking zone is kept lower than $P_{H2O}/P_{H2}$ in a heating zone, Japanese Unexamined Patent Publication No. 2000-96149 the method wherein a heating rate is controlled to 12 to 40° C./sec. on average in a temperature range from ordinary temperature to 750° C. and to 0.5 to 10° C./sec. on average in a temperature range from 750° C. to a soaking temperature, and Japanese Unexamined Patent Publication No. H10-152725 the method wherein the an oxygen amount on the surface of a steel sheet after decarburization annealing is controlled in the range from 550 to 850 ppm.

Further, with regard to an annealing separator composed mainly of MgO and applied after decarburization annealing, Japanese Unexamined Patent Publication No. H8-253819 discloses the method wherein the coating amount of an annealing separator is controlled to 5 g/m$^2$ or more, and Japanese Unexamined Patent Publication No. H10-25516 the method wherein an Ig-loss value is controlled in the range from 0.4 to 1.5%.

Furthermore, with regard to a Ti chemical compound, represented by $TiO_2$, used as an additive to MgO, many technologies have been proposed. As such methods in the case of a base material not containing Bi, Japanese Examined Patent Publication No. S49-29409 disclosed the method wherein anatase-type $TiO_2$ of 2-20 is blended with MgO of 100 as parts by weight, Japanese Examined Patent Publication No. S51-12451 the method wherein a Ti chemical compound of 2-40 is blended with an MgO chemical compound of 100 as parts by weight, Japanese Unexamined Patent Publication No. S54-128928 the method wherein $TiO_2$ of 1-10 as parts by weight and $SiO_2$ of 1-10 as parts by weight are contained as parts by weight, and Japanese Unexamined Patent Publication No. H5-195072 the method wherein a Ti chemical compound of 1-40 in terms of $TiO_2$ is blended as parts by weight and an atmosphere containing nitrogen is used at the first stage of purification annealing.

As such methods in the case of a base material containing Bi, Japanese Unexamined Patent Publication No. 2000-96149 discloses the method wherein $SnO_2$, $Fe_2O_3$, $Fe_3O_4$ and $MoO_2$ are added by 0-15 as parts by weight, further $TiO_2$ is added by 1.0-15 as parts by weight, and by so doing, film adhesiveness is improved. However, since a finish annealing process is generally applied to a steel sheet in the state of a coil, temperature deviation and the deviation of the distributability of an atmosphere occur in the coil, and therefore it has been difficult to control dissociative reaction of such $SnO_2$, $Fe_2O_3$, $Fe_3O_4$ and $MoO_3$. Further, Japanese Unexamined Patent Publication No. 2000-144250 discloses the method wherein a Ti chemical compound of 1-40 is blended as parts by weight, the nitrogen concentration is raised temporarily in accordance with the amount of the Ti chemical compound after the completion of secondary recrystallization, and by so doing, Ti is prevented from intruding into a steel. However, a problem of the method has been that the time of completion of secondary recrystallization is difficult to judge because of the temperature deviation in a coil as stated above.

With regard to a finish annealing process, Japanese Unexamined Patent Publication No. H9-3541 discloses the technology wherein the flow rate of an atmosphere gas at finish annealing is controlled so that the value of "atmosphere gas flow rate/(furnace inner volume−steel sheet volume)" may be not less than 0.5 $Nm^3/hr./m^3$. However, by the technology, the distributability of an atmosphere deviates between steel sheet layers in a coil, and therefore a desired effect is not obtained.

As explained above, in the case of a steel containing Bi, it is difficult to form a primary film uniformly by the aforementioned methods. Moreover, adhesiveness deteriorates when an insulating film having a film tension is applied, and poor secondary recrystallization, poor magnetic property in terms of low magnetic flux density occurs in the longitudinal direction when annealing is applied to a steel sheet in the state of a coil. Therefore, a problem of the above methods has been that it is difficult to obtain reduced iron loss at high magnetic flux density and good film adhesiveness distributing uniformly in the width and longitudinal directions when an insulating film is applied after finish annealing.

DISCLOSURE OF THE INVENTION

As explained above, by the prior production methods, it has been difficult to stably obtain a primary film having excellent iron loss at high magnetic flux density and good adhesiveness in a grain-oriented electrical steel sheet truly excellent in terms of low iron loss and a high magnetic flux density $B_8$ of 1.94 T or more. The object of the present invention is to provide a production method that solves the above problems, specifically to provide a grain-oriented electrical steel sheet excellent in iron loss at high magnetic flux density and film adhesiveness in excess of a conventional grain-oriented electrical steel sheet. The gist of the present invention for solving the aforementioned problems is as follows:

(1) An ultra-high magnetic flux density grain-oriented electrical steel sheet excellent in iron loss at high magnetic flux density and film properties, the grain-oriented electrical steel sheet containing 2 to 7% Si in mass as an indispensable component, characterized in that Bi is present at the interface between the substrate steel and the primary film.

(2) An ultra-high magnetic flux density grain-oriented electrical steel sheet excellent in iron loss at high magnetic flux density and film properties, the grain-oriented electrical steel sheet containing 2 to 7% Si in mass as an indispensable component, characterized in that Bi is present at 0.01 to less than 1,000 ppm in weight at the interface between the substrate steel and the primary film.

(3) An ultra-high magnetic flux density grain-oriented electrical steel sheet excellent in iron loss at high magnetic flux density and film properties, the grain oriented electrical steel sheet containing 2 to 7% Si in mass as an indispensable component, characterized in that Bi is present at by 0.1 to less than 100 ppm in weight at the interface between the substrate steel and the primary film.

(4) An ultra-high magnetic flux density grain-oriented electrical steel sheet excellent in iron loss at high magnetic flux density and film properties according to any one of the items (1) to (3), characterized by having a very high magnetic flux density $B_8$ of 1.94 T or more.

(5) An ultra-high magnetic flux density grain-oriented oriented electrical steel sheet excellent in iron loss at high magnetic flux density and film properties according to any one of the items (1) to (4), characterized in that the ratio of $W_{19/50}$ to $W_{17/50}$ is less than 1.8, where $W_{15/50}$ represents an energy loss under the excitation conditions of 1.9 T in $B_8$ and 50 Hz and $W_{17/50}$ the same under the excitation conditions of 1.7 T in $B_8$ and 50 Hz.

(6) An ultra-high magnetic flux density grain-oriented electrical steel sheet excellent in iron loss at high magnetic flux density and film properties according to any one of the items (1) to (5), characterized by showing such low degradation at a very high magnetic field that the ratio of $W_{19/50}$ to $W_{17/50}$ is less than 1.6 after magnetic domain control.

(7) An ultra-high magnetic flux density grain-oriented electrical steel sheet excellent in iron loss at high magnetic flux density and film properties according to any one of the items (1) to (6), characterized by being reduced iron loss at a high magnetic flux density that $W_{19/50}$ is not more than 1.2 W/kg after magnetic domain refining treatment.

(8) A method for producing a high magnetic flux density grain-oriented electrical steel sheet excellent in film properties and excellent in iron loss at high magnetic flux density wherein a grain-oriented electrical hot-rolled steel sheet containing, in mass, not more than 0.15% C, 2 to 7% Si, 0.02 to 0.30% Mn, one or both of S and Se by 0.001 to 0.040% in total, 0.010 to 0.065% acid-soluble Al, 0.0030 to 0.0150% N and 0.0005 to 0.05% Bi as basic components, with the balance consisting of Fe and unavoidable impurities, is subjected to the processes of: annealing if occasion demands; cold rolling once or more or cold rolling twice or more with intermediate annealing interposed in between; decarburization annealing; thereafter applying and drying an annealing separator; and finish annealing, characterized by subjecting the steel sheet cold rolled to the final thickness to: heating to a temperature of 700° C. or higher for not longer than 10 sec. or at a heating range of 100° C./sec. or more; immediately thereafter preliminary annealing for 1 to 20 sec. at 700° C. or higher; and subsequently decarburization annealing.

(9) A method for producing an ultra-high magnetic flux density grain-oriented electrical steel sheet excellent in iron loss at high magnetic flux density and film properties, wherein a grain-oriented electrical hot-rolled steel sheet containing, in mass, not more than 0.15% C, 2 to 7% Si, 0.02 to 0.30% Mn, one or both of S and Se by 0.001 to 0.040% in total, 0.010 to 0.065% acid-soluble Al, 0.0030 to 0.015% N and 0.0005 to 0.05% Bi as basic components, with the balance consisting of Fe and unavoidable impurities, is subjected to the processes of: annealing of occasion demands; cold rolling once or more or cold rolling twice or more with intermediate annealing interposed in between; decarburization annealing; thereafter applying and drying an annealing separator; and finish annealing, characterized by subjecting the steel sheet cold rolled to the final thickness to, prior to decarburization annealing; heating to a temperature of 700° C. or higher for not longer than 10 sec. or at a heating rate of 100° C./sec. or more; immediately thereafter preliminary annealing for 1 to 20 sec. at 700° C. or higher; and heat treatment in an atmosphere that is composed of $H_2O$ and an inert gas, $H_2O$ and $H_2$, or $H_2O$ and an inert gas and $H_2$ and has an $H_2O$ partial pressure being controlled in the range from $10^{-4}$ to $6\times10^{-1}$ in the temperature range.

(10) A method for producing an ultra-high magnetic flux density grain-oriented electrical steel sheet excellent in iron loss at high magnetic flux density and film properties according to the item (8) or (9), characterized in that the heat treatment is applied as the heating stage of the decarburization annealing.

(11) A method for producing a grain-oriented electrical steel sheet excellent in iron loss at high magnetic flux density $B_8$ of 1.94 T or more, wherein a grain-oriented electrical hot-rolled steel sheet containing, in mass, not more than 0.15% C, 2 to 7% Si, 0.02 to 0.30% Mn, one or both of S and Se by 0.001 to 0.040% in total, 0.010 to 0.065% acid-soluble Al, 0.0030 to 0.0150% N and 0.0005 to 0.05% Bi as basic components, with the balance consisting of Fe and unavoidable impurities, is subjected to the processes of: annealing if occasion demands; cold rolling once or more or cold rolling twice or more with intermediate annealing interposed in between; decarburization annealing; thereafter applying and drying an annealing separator; and finish annealing, characterized by controlling the maximum arrival temperature at annealing before finish cold rolling in the range defined by the following expression in accordance with Bi content and, prior to decarburization annealing, heating the steel sheet cold rolled to the final thickness to a temperature of 700° C. or higher for not longer than 10 sec. or at a heating rate of 100° C./sec. or more;

$$-10\times\ln(A)+1{,}100\leqq B\leqq-10\times\ln(A)+1{,}220,$$

where A means a Bi content (ppm) and B a temperature (° C.) at annealing before finish cold rolling.

(12) A method for producing a grain-oriented electrical steel sheet excellent in iron loss at high magnetic flux density $B_8$ of 1.94 T or more according to any one of the items (8) to (10), characterized by controlling the maximum attaining temperature at annealing before finish cold rolling in the range defined by the following expression in accordance with Bi content;

$$-10\times\ln(A)+1{,}100\leqq B\leqq-10\times\ln(A)+1{,}220,$$

where A means a Bi content (ppm) and B a temperature (° C.) at annealing before finish cold rolling.

(13) A method for producing a grain-oriented electrical steel sheet excellent in iron loss at high magnetic flux density $B_8$ of 1.94 T or more according to any one of the items (8) to (12), characterized by controlling the maximum attaining temperature at annealing before finish cold rolling in the range defined by the following expression in accordance with Bi content;

$$-10\times\ln(A)+1{,}130\leqq B\leqq-10\times\ln(A)+1{,}220,$$

where A means a Bi content (ppm) and B a temperature (° C.) at annealing before finish cold rolling.

(14) A method for producing an ultra-high magnetic flux density grain-oriented electrical steel sheet excellent in film properties and excellent in iron loss at high magnetic flux density according to any one of the items (8) to (13), characterized by controlling an addition amount of $TiO_2$ contained in an annealing separator mainly composed of MgO and the amount of the annealing separator applied on each side of the steel sheet in the range defined by the following expression (1) in accordance with Bi content;

$$A^{0.8}\leqq B\times C\leqq400 \quad (1),$$

where A means a Bi content (ppm), B a $TiO_2$ amount added in relation to MgO of 100 as parts by weight, and C an amount ($g/m^2$) of an annealing separator applied on each side of a steel sheet.

(15) A method for producing an ultra-high magnetic flux density grain-oriented electrical steel sheet excellent in film properties and excellent in iron loss at high magnetic flux density according to any one of the items (8) to (14), characterized by controlling an addition amount of $TiO_2$ contained in an annealing separator mainly composed of MgO and the amount of MgO applied on each side of the steel sheet in the range defined by the following expression (2) in accordance with Bi content;

$$4\times A^{0.8}\leqq B\times C\leqq400 \quad (2),$$

where A means a Bi content (ppm), B a $TiO_2$ amount added in relation to MgO of 100 as parts by weight, and C an amount ($g/m^2$) of an annealing separator applied on each side of a steel sheet.

BEST MODE FOR CARRYING OUT THE INVENTION

Figure 1:
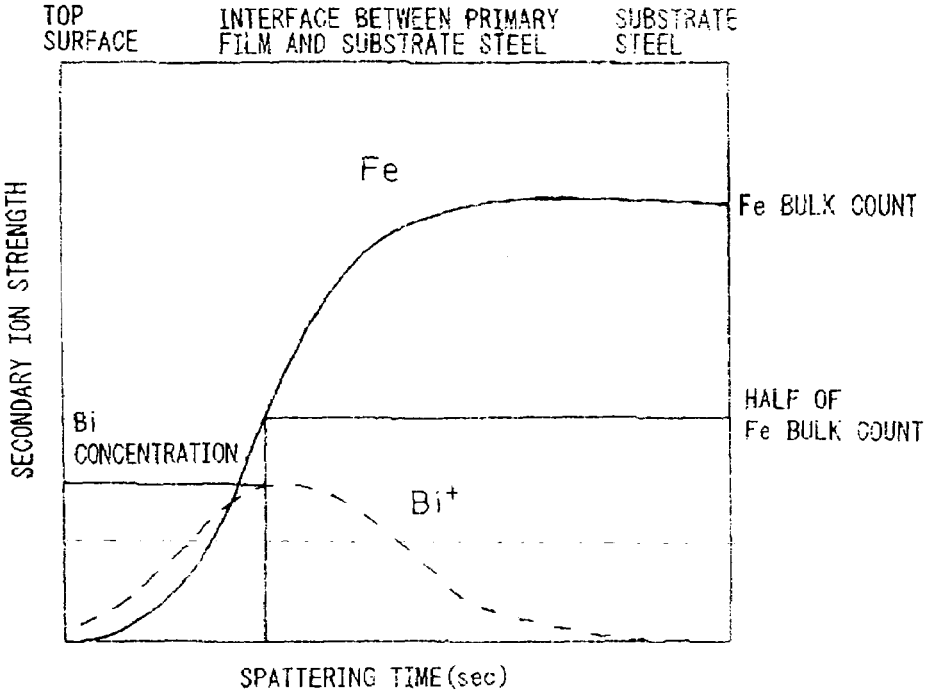
FIG. 1 is a diagrammatic illustration showing the profiles of Fe and Bi of a grain-oriented electrical steel sheet in secondary ion mass spectrometry (SIMS).

The present invention is hereunder explained in detail.

The present inventors, as a result of repeated studies with intent to develop a grain-oriented electrical steel sheet having an excellent iron loss at the high magnetic flux density and good primary film adhesiveness, found that it was very important for Bi to be contained in a steel and to control the Bi concentration at the interface between a primary film and a substrate steel during secondary recrystallization annealing for the formation of the primary film and the {110}<001> orientations.

With this in mind, the present inventors tried various methods for producing an ultra-high magnetic flux density grain-oriented electrical steel sheet by: variously changing an atmosphere at the time of heating and subsequent soaking conditions when Bi was contained in a steel and a heating rate was controlled to 100° C./sec. or more at primary recrystallization annealing or decarburization annealing; and investigating the relationship between the variables and the magnetic properties and film adhesiveness of a product after finish annealing. As a result, the present inventors found that a glass film structure that resulted in both excellent magnetic properties and excellent film adhesiveness of a product had features different from those of a conventional grain-oriented electrical steel sheet. In other words, they found that there is a close relationship between Bi present in an extremely small amount at the interface between a substrate steel and a primary film, and iron loss and secondary film adhesiveness.

Firstly, the method for analyzing Bi is explained. It is possible to detect and quantify Bi present in an extremely small amount at the interface between a substrate steel and a primary film by secondary ion mass spectrometry (SIMS).

The measurement method by SIMS is hereunder explained in detail. When Bi present in a primary film and in the vicinity of the interface between a substrate steel and a primary film is analyzed by SIMS, it is necessary to remove the interference of molecular ions composed of Fe, Mg, Si, etc. Measurement under the condition of a mass resolution of 500 or more makes it possible to achieve mass separation between Bi and the interfering ions. It is preferable to carry out the measurement under the condition of a mass resolution of 1,000 or more. For this reason, a secondary ion mass spectrometer equipped with a double focusing type mass spectrometer having a high mass resolution is preferably used. It becomes possible to detect a very small amount of Bi with a high sensitivity by measuring $Bi^+$ secondary ions when a $^{16}O_2^-$ ion beam is used as a primary ion beam or by measuring $Bi^-$ or $CsBi^+$ secondary ions when a $Cs^+$ ion beam is used as a primary ion beam. On the basis of the measurement depth and a Bi concentration, the kind of primary ion beam, energy, irradiation area and electric current can be determined.

Next, the quantitative measurement method of Bi is hereunder explained in detail. As the method for determining a Bi concentration from a Bi secondary ion strength obtained by SIMS measurement, a method similar to the quantitative measurement method of B in an Si wafer stipulated in ISO 14237 is used. A standard sample is prepared by subjecting a steel sheet that is mirror-finished by polishing the surface of the substrate steel not containing Bi in the depth of about 10 μm from the interface between the substrate steel and a primary film to ion implantation by applying a prescribed dose of Bi with a known energy. Further, the matrix strength for computing a relative sensitivity coefficient of Bi is measured in the substrate steel after a primary film is subjected to sputtering. In order to avoid interference by $^{28}Si_2$ molecular ions, a $^{54}Fe^+$ secondary ion strength is used as a matrix strength when positive secondary ions are detected by using a $^{16}O_2^+$ primary ion beam, a $^{54}Fe^-$ secondary ion strength is used when negative secondary ions are detected by using a $Cs^+$ primary ion beam, or a $^{54}Fe^-$ secondary ion strength is used when positive secondary ions are detected by using a $Cs^+$ primary ion beam.

The secondary ionization rate, the sputter rate and the relative sensitivity coefficient of Bi in a primary film are different from those in a substrate steel, the thickness of a primary film is not uniform, and the interface between a substrate steel and a primary film is not flat. For these reasons, it is extremely difficult to determine exactly the Bi concentration distribution ranging from the surface of a primary film to the interior of a substrate steel. However, it is possible to convert a Bi secondary ion strength distribution ranging from the surface of a primary film to the interior of a substrate steel into an apparent Bi concentration distribution by using the relative sensitivity coefficient of Bi in the substrate steel of the above standard sample. In the present invention, an aforementioned apparent Bi concentration is defined as a Bi concentration.

FIG. 1 is a diagrammatic illustration of a $Bi^+$ profile of a grain-oriented electrical steel sheet 0.23 mm in thickness after finish annealing, namely before the insulation coating treatment or after the removal of an insulating film, obtained by secondary ion mass spectrometry (SIMS). In FIG. 1, the peak of a Bi concentration is on the side where the secondary ion strength of Fe is lower than the bulk strength (on the side of the steel sheet surface). Since a primary film and a substrate steel form an intricate structure, the profile of Fe rises gradually from a surface and thereafter reaches a constant value. In the present invention, the case where a $Bi^-$ secondary ion strength is detected (counted) at the discharge time when a Fe secondary ion strength is 50% of the bulk strength is defined as the case where Bi is present at the interface between a primary film and a substrate steel. Further, if the quantification of Bi is required in the present invention, a Bi concentration converted from a $Bi^-$ secondary ion strength at the discharge time when a Fe secondary ion strength is 50% of the bulk strength is defined as a Bi concentration at the interface between a primary film and a substrate steel.

The concentration of Bi present at the interface between a substrate steel and a surface film determined by the above method varies in accordance with production methods.

Figure 2:
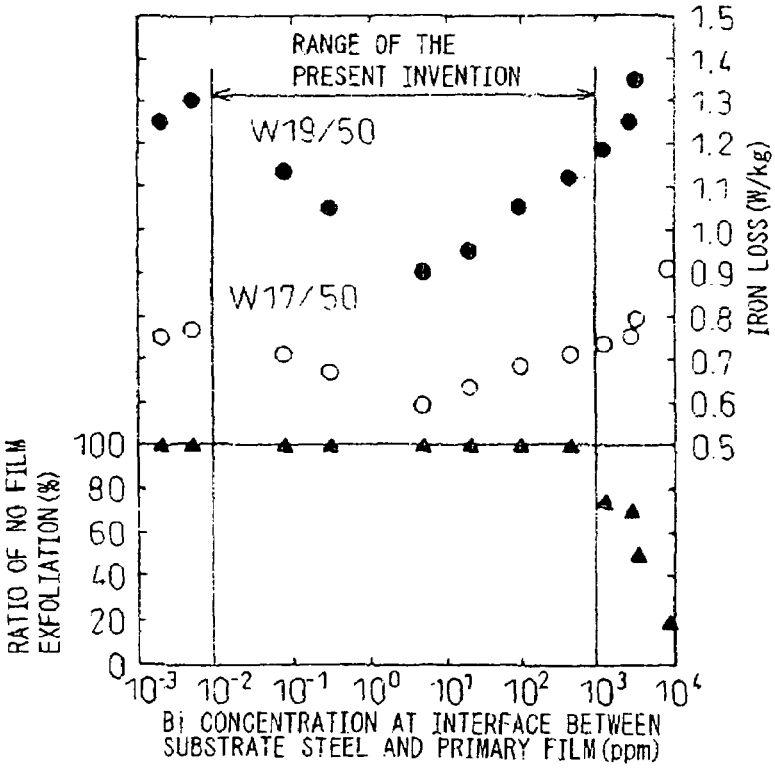
FIG. 2 is a graph showing the relationship among Bi concentration at the interface between a substrate steel and a primary film, a ratio of no film exfoliation and the values of $W_{17/50}$ and $W_{19/50}$.

With this in mind, the concentration of Bi present at the interface between a substrate steel and a primary film, $W_{17/50}$, $W_{19/50}$ and film adhesiveness of each of grain-oriented electrical steel sheets 0.23 mm in thickness were measured. Iron loss was evaluated after each of the steel sheets was subjected to magnetic domain refinement treatment with a laser. Film adhesiveness was evaluated by the incidence (%) of cases where no exfoliation was observed when bending of 20 mm diameter curvature was applied. FIG. 2 shows the relationship among the concentration of Bi present at the interface between a substrate steel and a primary film, $W_{17,50}$ and $W_{19/50}$ of a steel sheet, and film adhesiveness. It shows that, with a Bi concentration of not less than 0.01 ppm, the value of $W_{19/50}$ is less than 1.2 W/kg and thus a good iron loss at high magnetic flux density is obtained, and, with a Bi concentration of not more than 1,000 ppm, exfoliation of a primary film rarely occurs and thus film adhesiveness is improved. Further, it is understood that, with a Bi concentration in the range from 0.1 to 100 ppm, a good iron loss at high magnetic flux density is obtained and film adhesiveness is also good.

Figure 3:
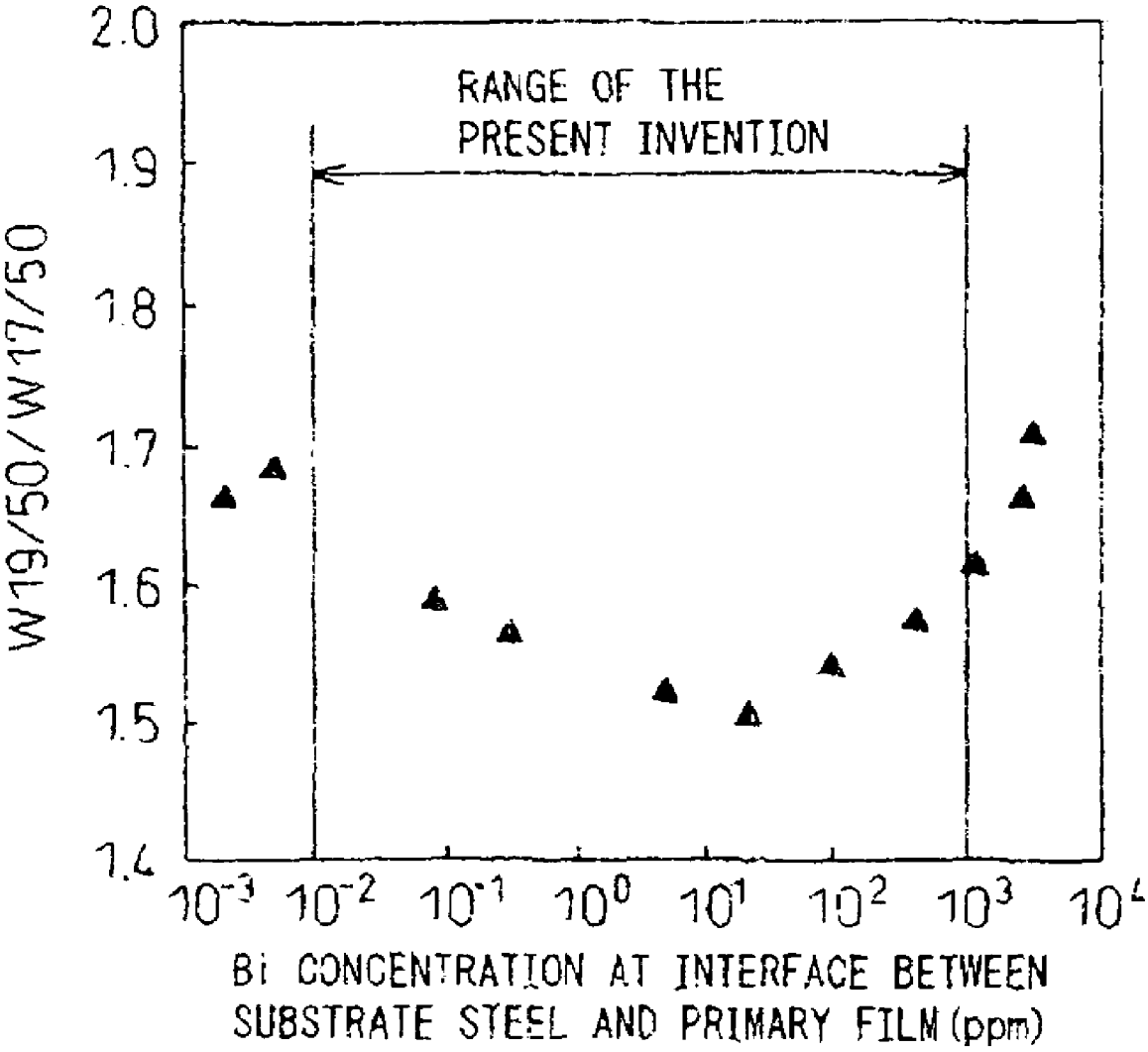
FIG. 3 is a graph showing the relationship between Bi concentration at the interface between a substrate steel and a primary film and the ratio of $w_{19/50}$ to $W_{17/50}$.

FIG. 3 shows the results of investigating the relationship between a Bi concentration at the interface between a substrate steel and a primary film and the ratio of $W_{19/50}$ to $W_{17/50}$. The ratio of $W_{19/50}$ to $W_{17/50}$ represents the degree of degradation from $W_{17/50}$ to $W_{19/50}$. From FIG. 3, it is clear that when a Bi concentration at the interface between a substrate steel and a primary film is in the range from 0.01 to 1,000 ppm, the degree of degradation is less than 1.6. Further, when the Bi concentration is in the range from 0.01 to 100 ppm, the degree of degradation is particularly small.

Although the reason the aforementioned correlation holds among the concentration of Bi present at the interface between a substrate steel and a primary film, iron loss at high magnetic flux density and glass film adhesiveness is not yet clear, it is considered to be as explained below.

A finish annealing process successively applied after the application of MgO plays the role of purification annealing wherein a primary film is formed, secondary recrystallization is caused and impurities in a steel are removed. A primary film is formed by making $SiO_2$ that is formed on a steel sheet surface in decarburization annealing react to an annealing separator that is applied thereafter in the finish annealing process. In general, an annealing separator is mainly composed of MgO and it reacts to $SiO_2$ and forms $Mg_2SiO_4$.

In the case of this process, it is believed that adhesiveness between a primary film and a steel sheet is determined by the interface structure thereof and, when the interface between a primary film and a steel sheet has an intricate structure, primary adhesiveness is good. On the other hand, if the interface between a primary film and a substrate steel is too intricate, although film adhesiveness is good due to the anchor effect caused by the intricate structure, the depth of the primary film anchor, which is not a problem in the case of a conventional product, has a very important effect and iron loss reduces particularly in a high magnetic flux density in the case of a grain-oriented electrical steel sheet having an ultra-high magnetic flux density according to the present invention. Therefore, in order to increase iron loss at high magnetic flux density and ensure good adhesiveness, it is necessary to optimize the structure at the interface between a primary film and a substrate steel. A very small amount of Bi present at the interface between a primary film and a substrate steel plays an important role on the structure of the interface.

Bi is an element essential for ensuring a high magnetic flux density. However, when Bi remains in the substrate steel of a product, it degrades its magnetic properties. Therefore, Bi is removed from a steel in the state if a gas or a chemical compound after secondary recrystallization, namely during or after the formation of a primary film. At the time, Bi is removed from the substrate steel through the interface between the primary film and the substrate steel. In this case, it is believed that when Bi incrassates in excess of a prescribed amount at the interface between the primary film and the substrate steel, Bi forms a low melting point chemical compound combining with the primary film, and resultantly the structure of the interface between the primary film and the substrate steel smoothes, pinning of magnetic domain walls disappears at the interface, and iron loss increases at high magnetic flux density.

It is believed that in order to secure a certain amount of Bi existing at an interface, it is important to suppress the diffusion of Bi before or during the removal of Bi and, for that purpose, to simplify the structure of the interface. In the case where the structure of the interface between a substrate steel and a primary film is intricate, the area of the diffusion interface increases and therefore the sites of removal of Bi increase and the removal of Bi is accelerated. As a result, the Bi concentration at the interface decreases and therefore the intricate structure of the interface is maintained. In contrast, when the area of the interface between a substrate steel and a primary film is small and Bi incrassates excessively, the interface smoothes excessively, the anchor effect between the primary film and the substrate steel disappears, and the film adhesiveness deteriorates. Furthermore, it is believed that since film tension decreases, the effect of the tension on the reduction of iron loss diminishes, and magnetic properties also deteriorate.

On the basis of this, the present inventors repeated studies and found that the interface structure between a primary film and a substrate steel at the time of the removal of Bi could be changed by controling the initial state of oxide film formation in decarburization annealing and optimizing the Bi concentration at the interface between the primary film and the substrate steel.

The present inventors found that an initial oxide layer composed mainly of $SiO_2$ forming at a surface layer when a steel sheet was rapidly heated at a rate of 100° C. or more depended largely on atmospheric conditions during or immediately after the heating and the soaking time immediately after the heating, and greatly influenced the structure of an internal oxide layer at the subsequent decarburization annealing and the structure of a primary film at finish annealing after the application of MgO. Further, the present inventors found that such structure of a primary film influenced the behavior of Bi removal that started at a high temperature of 1,000° C. or higher, and optimized the structure of the interface between the primary film and a substrate steel.

Good primary film properties of a product according to the present invention are obtained by setting the heating rate at 100° C./sec. in decarburization annealing and controlling the atmosphere during the heating and at the initial stage of subsequent soaking. It is disclosed in the paragraph [0035] of Japanese Unexamined Patent Publication No. 2000-204450 that, with regard to an oxide film formed in the event of rapid heating at a rate of 100° C./sec. or more in decarburization annealing in comparison with a conventional heating, despite the fact that the atmosphere during the heating is mostly in the range of forming FeO that is harmful from the viewpoint of equilibrium, such Fe-type oxides are scarcely formed, and instead an oxide layer composed mainly of $SiO_2$ is formed, and therefore the oxide formation is strongly dependent on non-equilibrium.

The present inventors further continued investigations and resultantly found that, in the case of the addition of Bi, a good primary film could be obtained rather by applying preliminary annealing properly after rapid heating and prior to decarburization annealing. In the case of rapid heating, an oxide layer composed mainly of $SiO_2$ is formed and the amount of $SiO_2$ varies in accordance with the conditions at soaking immediately after heating. Such as $SiO_2$ amount is believed to represent the coverage ratio of $SiO_2$ in a surface layer and, when a preliminary annealing time is too long or $P_{H2O}$ is too high, the coverage ratio of $SiO_2$ is excessive, the depth of an internal oxide layer tends to increase excessively, the removal of Bi is accelerated, the structure of the internal oxide layer becomes too intricate, and thus magnetic flux density and iron loss at high magnetic flux density are decreased.

On the other hand, when a preliminary annealing time is short of $P_{H2O}$ is low, such a coverage ratio is as small as that of an internal oxide film obtained in ordinary decarburization annealing, the interface between a primary film and a substrate steel is not intricate during the subsequent finish annealing, the removal of Bi is not accelerated, thus Bi incrassates at the interface, and the adhesiveness of the primary film deteriorates. Therefore, it is important to optimize the coverage ratio of $SiO_2$ that constitutes an initial oxide film by controlling the preliminary annealing time and $P_{H2O}$.

Next, the conditions of compositions in the present invention are explained. When the C amount exceeds 0.15%, not only is a long decarburization time required in decarburization annealing after cold rolling and thus economical efficiency is low, but also decarburization tends to be incomplete and gives rise to a poor magnetic property called magnetic aging. On the other hand, when the C amount is less than 0.02%, crystal grains extremely grow at the time of slab heating prior to hot rolling and poor secondary recrystallization called linear fine grains occurs.

Si is an element effective for raising electric resistance of a steel and thus reducing eddy current loss that constitutes a part of iron loss. However, when the Si amount is less than 2%, the eddy current loss of a product is not suppressed. On the other hand, when the Si amount exceeds 7.0%, workability deteriorates noticeably and thus cold rolling cannot be applied at the ordinary temperature.

Mn is an important element that forms MnS and/or MnSe, called an inhibitor, and which governs secondary recrystallization. When the Mn amount is less than 0.02%, the absolute amount of MnS and/or MnSe required for the secondary recrystallization is insufficient. On the other hand, when the Mn amount exceeds 0.3%, solid solution cannot be obtained at the time of slab heating, crystals precipitating during hot rolling are likely to coarsen, and the optimum size distribution as an inhibitor is not obtained.

S and Se are important elements that form MnS and/or MnSe in combination with the aforementioned Mn. When the total amount of S and Se deviates from the aforementioned range, a sufficient inhibitor effect is not obtained. Therefore, the total amount of S and Se must be regulated in the range from 0.001 to 0.040%.

Acid-soluble Al is a main element constituting an inhibitor for a high magnetic flux density grain-oriented electrical steel sheet. When the amount of acid-soluble Al is less than 0.010%, sufficient inhibitor strength is not obtained. In contrast, when the amount of acid-soluble Al exceeds 0.065%, AlN precipitating as an inhibitor coarsens and, as a result, the inhibitor strength is reduced.

N is an important element that forms AlN in combination with the aforementioned acid-soluble Al. When the N amount deviates from the aforementioned range, a sufficient inhibitor effect cannot be obtained. For this reason, the N amount must be regulated in the range from 0.0020 to 0.0150%.

Further, in addition to the aforementioned component elements, Sn, Cu, Sb and Mo may be added in the present invention.

Sn may be added as an element for ensuring stable secondary recrystallization of a thin product and has the function of reducing the size of secondarily recrystallized grains. An Sn addition amount of 0.05% or more is necessary for ensuring this effect. In contrast, even when an Sn amount exceeds 0.50%, the above mentioned effect is saturated. Therefore, the Sn amount is limited to 0.50% or less from the viewpoint of cost.

Cu is used to stabilize the formation of a primary film in an Sn-added steel. However, when the Cu amount is less than 0.01%, the effect is insufficient. On the other hand, when the Cu amount exceeds 0.40%, the magnetic flux density of a product is undesirably lowered.

Sb and/or Mo may be added in order to ensure secondary recrystallization of a thin product. In this case, an addition amount of 0.0030% or more is necessary for obtaining the effect. On the other hand, when the addition amount exceeds 0.30%, the above-mentioned affect is saturated. Therefore, the amount is limited to 0.30% or less from the viewpoint of cost.

Bi is an element indispensably included in a slab used for the stable production of an ultra-high magnetic flux density grain-oriented electrical steel sheet having $B_8$ of 1.94 T or more according to the present invention, and has the effect of improving the magnetic flux density. However, when the Bi amount is less than 0.0005%, this effect is not obtained sufficiently. On the other hand, when the Bi amount exceeds 0.05%, not only is the effect of improving magnetic flux density saturated but also cracks are generated at the ends of a hot-rolled coil.

Next, methods for stably producing a primary film and reducing iron loss in the present invention are explained.

Molten steel having components adjusted as mentioned above for producing an ultra-high magnetic flux density grain-oriented electrical steel sheet is cast by an ordinary method. Thereafter, the cast slabs are rolled into hot-rolled coils through ordinary hot rolling.

Successively, each of the hot-rolled coils is finish-rolled to a product thickness through cold rolling after hot band annealing, a plurality of cold rollings with intermediate annealing interposed in between, or a plurality of cold rollings with intermediate annealing interposed in between after hot band annealing. In the annealing prior to the finish cold rolling, the crystal structure is homogenized and the precipitation of AlN is controlled.

A strip rolled to a final product thickness as mentioned above is subjected to decarburization annealing.

A steel sheet cold rolled to a final thickness is, prior to decarburization annealing, heated to a temperature of 700° C. or higher at a heating rate of 100° C./sec. or more and thereafter soaked at a temperature of 700° C. or higher for a soaking time of 1 to 20 sec. while the atmosphere in the temperature range is adjusted so as to be composed of $H_2O$ and an inert gas, $H_2O$ and $H_2$, or $H_2O$ and an inert gas and $H_2$, and to have an $H_2O$ partial pressure controlled in the range from $10^{-4}$ to $6\times10^{-1}$.

The aforementioned heating rate represents an average heating rate in the range from 20° C. to a maximum attaining temperature of 700° C. or higher, which is important in the formation of an initial oxide film. A heating rate in the range from 300° C. to 700° C. is particularly important and, when an average heating rate in the temperature range is less than 100° C./sec., primary film adhesiveness deteriorates. When a maximum attaining temperature is 700° C. or lower, an $SiO_2$ layer is not formed. Therefore, the lower limit of a maximum attaining temperature is set at 700° C. Further, the time for heating up to 700° C. is 10 sec. or longer, an appropriate $SiO_2$ layer is not formed. Induction heating or conduction heating may preferably be adopted as a heating means for obtaining such a high heating rate.

Next, preliminary annealing applied immediately after rapid heating and prior to decarburization annealing is explained. When the preliminary annealing temperature is 700° C. or lower, an appropriate $SiO_2$ layer is not formed. Therefore, the preliminary annealing temperature is set at 700° C. or higher. When the preliminary annealing time exceeds 20 sec. or the $H_2O$ partial pressure exceeds $6\times10^{-1}$, although a sufficient $SiO_2$ amount is ensured, decarburization is insufficient, the removal of Bi is excessively accelerated at finish annealing, the structure of the interface between a primary film and a substrate steel becomes complicated, and high magnetic field iron loss decreases. On the other hand, when the soaking time is less than 1 sec. or the $H_2O$ partial pressure is less than $10^{-4}$, since an appropriate $SiO_2$ amount is not obtained, the removal of Bi is not accelerated, Bi incrassates excessively at an interface, and film adhesiveness deteriorates. An atmosphere at the heating and succeeding preliminary annealing may be changed as long as it is in the aforementioned range.

Decarburization annealing is applied thereafter and in this case, the aforementioned heating treatment may be incorporated into the heating.

An atmosphere at decarburization annealing following the aforementioned preliminary annealing is the same as an ordinary atmosphere. In other words, an atmosphere composed of a mixture of $H_2$ and $H_2O$, or $H_2$ and $H_2O$ and an inert gas is adopted and the ratio $P_{H2O}/P_{H2}$ is controlled in the range from 0.15 to 0.65. In this case, it is necessary to control the carbon amount remaining after decarburization annealing to 50 ppm or less, similarly to an ordinary case. When only AlN is used as an inhibitor, it is acceptable to nitride a steel sheet by applying annealing in an atmosphere containing ammonium after decarburization annealing and to form an inhibitor at this stage.

An annealing separator composed mainly of MgO is applied to a steel sheet after decarburization annealing and dried. In this case, $TiO_2$ and the coating amount are regulated in the specific ranges as mentioned below.

Next, the present inventors found through the following experiment that, when the heating rate at primary recrystallization annealing was set at 100° C./sec. or more for further stably obtaining a so-called ultra-high magnetic flux density grain-oriented electrical steel sheet, the annealing temperature before finish cold rolling and the Bi content influenced magnetic properties considerably.

Slabs for grain-oriented electrical steel sheets containing 0.075% C, 3.25% Si, 0.08% Mn, 0.025% S, 0.026% acid-soluble Al and 0.008% N, those being in the ranges stipulated in the present invention, and further containing Bi varying from 0.0001 to 0.03%, were used as the start materials, and heated to a temperature of 1,400° C. and then hot rolled to produce hot-rolled steel sheets 2.3 mm in thickness.

Successively, the hot-rolled steel sheets were subjected to hot band annealing while the maximum attaining temperature was varied in the range from 950° C. to 1,230° C., and thereafter pickling and cold rolling were carried out, and steel sheets 0.22 mm in thickness were finished. Thereafter, the cold-rolled steel sheets were heated to 850° C. at a heating rate of 500° C./sec. in an atmosphere having $P_{H2O}/P_{H2}$ of 0.6 and subsequently subjected to decarburization annealing at 800° C. in a wet atmosphere. Then, the steel sheets were coated with an annealing separator composed mainly of MgO and then subjected to finish annealing for 20 hr. at 1,200° C.

An insulating film composed mainly of phosphate and colloidal silica was burnt into each of the annealed steel sheets and magnetic domain refinement treatment was applied by laser irradiation. The laser irradiation was applied under the conditions of irradiation row intervals of 6.5 mm, irradiation spot intervals of 0.6 mm, and irradiation energy of 0.8 mJ/mm$^2$. Thereafter, magnetic properties were measured.

Figure 4:
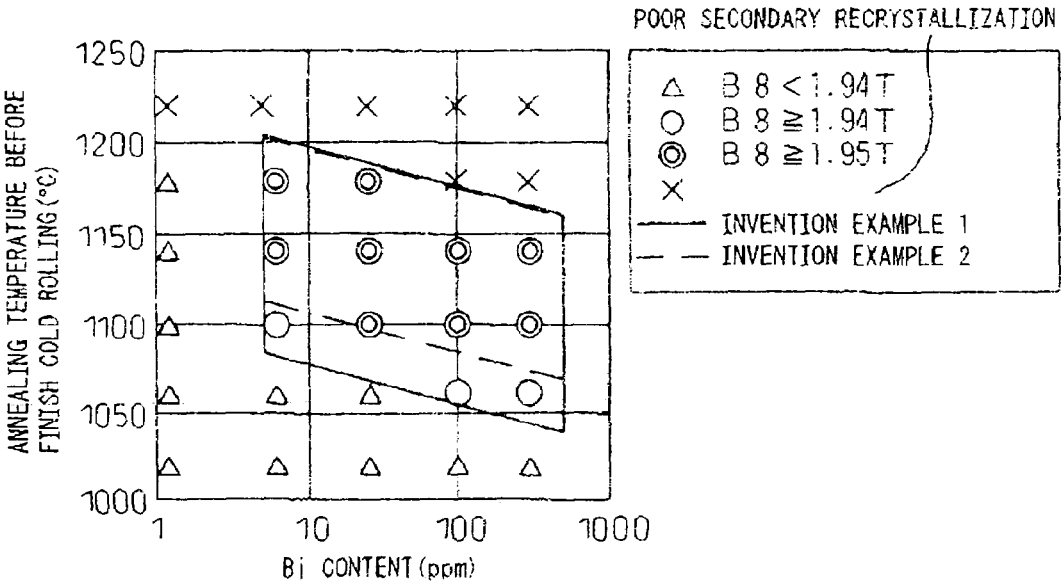
FIG. 4 is a graph showing the influences of Bi content and temperature before finish cold rolling on a magnetic flux density $B_8$.
Figure 5:
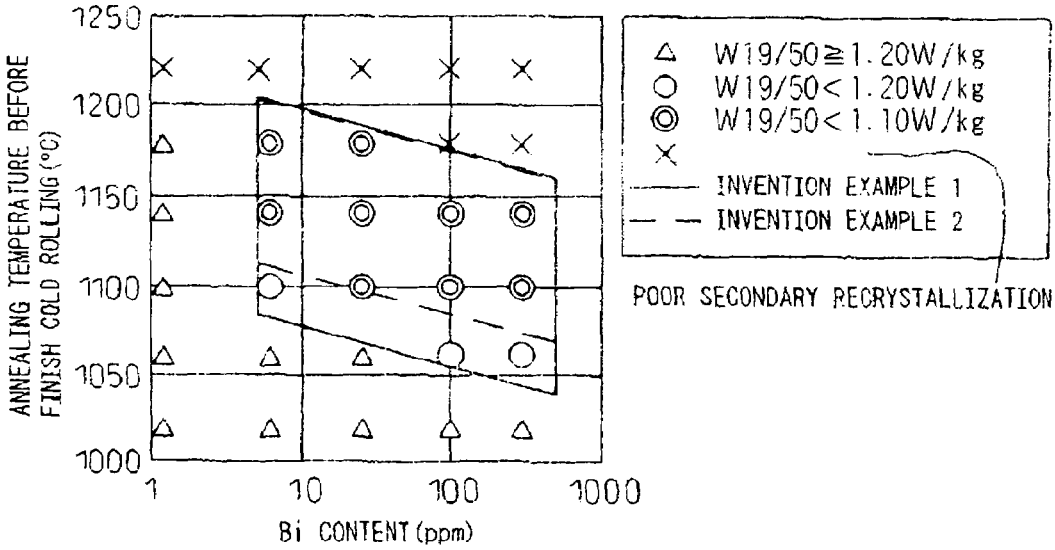
FIG. 5 is a graph showing the influences of Bi content and temperature before finish cold rolling on iron loss.

FIGS. 4 and 5 show the influence of Bi content and annealing temperature before finish cold rolling on magnetic flux density $B_8$ and iron loss. The annealing temperature before finish cold rolling whereat a high magnetic flux density and a reduced core loss are obtained tends to fall as a Bi content increases. Specifically, $B_8$ of 1.94 T or more and $W_{19/50}$ of 1.2 w/kg or less are obtained when the following expression is satisfied, $$-10\times ln(A)+1{,}100 \leqq \text{temperature before finish cold rolling (° C.)} \leqq -10\times ln(A)+1{,}220,$$

and particularly excellent magnetic properties are obtained when the following expression is satisfied, $$-10\times \ln(A)+1{,}130 \leqq \text{temperature before finish cold rolling (° C.)} \leqq -10\times ln(A)+1{,}220,$$

where A means a Bi content in ppm.

Although above explanations are based on an experiment carried out by the method of applying cold rolling once, similar results were attained also in the case of applying cold rolling twice while intermediate annealing is interpolated in between.

When Bi is contained in a base material, primarily recrystallized grains tend to coarsen and it has so far been necessary to lower the annealing temperature before finish cold rolling, fractionize a precipitation dispersion type inhibitor such as AlN, and thus suppress the coarsening of the primarily recrystallized grains, as disclosed in Japanese Unexamined Patent Publication No. H11-124627. In this case, since the annealing temperature before cold rolling varies between a material containing Bi and one not containing Bi, magnetic properties stable in the longitudinal direction have not been obtained.

However, as shown in FIG. 4, when such a material is rapidly heated at a heating rate of 100° C./sec. or more at primary recrystallization annealing or decarburization annealing, the optimum annealing temperature range before finish cold rolling shifts toward a higher range in comparison with the case of a conventional Bi containing material. For example, although Japanese Unexamined Patent Publication No. H6-212265 stipulates that the annealing temperature before finish cold rolling is in the range from 850° C. to 1,100° C. as mentioned above, the present invention requires a higher temperature. In the present invention, it is possible to raise the annealing temperature before finish cold rolling to higher than a conventionally adopted temperature and to suppress temperature variation by increasing the frequency of primary recrystallization nucleus formation and fractionizing primarily recrystallized grains due to rapid heating.

Further, an optimum temperature range before finish cold rolling shifts toward a lower temperature range as the Bi addition amount increases. This means that, since primarily recrystallized grains coarsen with the increase in Bi addition amount, primarily recrystallized grain size is adjusted by lowering the temperature before finish cold rolling.

Furthermore, the present inventors carried out an experiment wherein slabs for grain-oriented electrical steel sheets containing 0.0133% Bi in weight and using MnS and AlN as main inhibitors were used as the start materials, and subjected to heating, hot rolling, hot band annealing, a plurality of cold rollings with intermediate annealing interpolated in between to a finish product thickness, and primary recrystallization annealing or decarburization annealing while the heating rate and preliminary annealing time were varied. The heating rate was defined by the average heating rate in the temperature range from 300° C. to 800° C., a preliminary annealing temperature was 800° C., and $P_{H2O}$ was 0.01. Thereafter, decarburization annealing was applied, an annealing separator produced by blending $TiO_2$ of 5 to MgO of 100 as parts by weight was applied by 6 g/m$^2$ per one side, finish annealing was applied, a secondary film was applied and burnt, and then film adhesiveness was evaluated. Film adhesiveness was determined by the following procedure. A case where no film exfoliation appeared even when a product was bent along the surface of a round bar 20 mm in diameter was classified as A, a case where no film exfoliation appeared even when a product was bent along the surface of a round bar 30 mm in diameter as B, a case where no film exfoliation appeared even when a product was bent along the surface of a round bar 40 mm in diameter as C, and a case where film exfoliation appeared when a product was bent along the surface of a round bar 40 mm in diameter is D. Further, stress relief annealing was carried out after forming grooves 15 μm in depth and 90 μm in width at intervals at 5 mm in the direction of 10 degrees to the direction forming right angles to the strip traveling direction.

As a result, as shown in Table 1, in the case of applying rapid heating or preliminary annealing for 1 to 20 sec. after rapid heating, increased iron loss at high magnetic flux density, film adhesiveness and decarburization capability are obtained. In the case of the addition of Bi, when rapid heating or preliminary annealing time after rapid heating is optimized, $W_{19/50}$ and film adhesiveness improve as mentioned earlier.

TABLE 1

| Sample | Heating rate (° C./sec.) | Preliminary annealing time (sec.) | Iron loss, $W_{17/50}$ (W/kg) | Iron loss, $W_{19/50}$ (W/kg) | Film adhesiveness | Residual C (ppm) |
|---|---|---|---|---|---|---|
| A | 20 | 0.5 | 0.90 | 1.55 | D | 11 |
| B | 20 | 5 | 0.85 | 1.48 | D | 13 |
| C | 20 | 15 | 0.91 | 1.61 | D | 12 |
| D | 300 | 0.5 | 0.78 | 1.25 | C | 12 |
| E | 300 | 5 | 0.62 | 1.02 | A | 14 |
| F | 300 | 15 | 0.68 | 1.10 | A | 19 |
| G | 300 | 50 | 0.74 | 1.21 | A | 58 |

On the basis of the above knowledge, experiments were carried out in the coil form to stably produce high magnetic flux density grain-oriented electrical steel sheets having a magnetic flux density $B_8$ of 1.94 T or more on an industrial scale. As a result of investigating the primary films of the products, the adhesiveness was found to be better than the level D of conventional products, but some portions that deteriorated up to the level C were recognized in the coils. As a result of investigating the relationship between a portion having a poor primary film and the position in the coil, it was found that, whereas a film was good at an end of a coil, it deteriorated at the center of the width. This was presumably because Bi removed from a steel sheet was transformed into vapor during finish annealing and stayed between steel sheets and a primary film exfoliated at the center of the width, where gas permeability was poor in the coil. In the case of a small tabular specimen of an experimental size, it is easy to remove Bi vapor from between steel sheets, but in the case of production on an industrial scale, the production process is based on applying finish annealing to a steel sheet wound into a coil. As methods for removing Bi from between such steel sheet layers, Japanese Unexamined Patent Publication No. H9-279247 discloses the method wherein gas permeability is improved by introducing an electrostatic coating technology, Japanese Unexamined Patent Publication No. H9-3542 the method wherein the diffusion of Bi vapor is accelerated by controlling an atmospheric gas flow rate in finish annealing so that the ratio of an atmospheric gas flow rate to a furnace inner volume may be 0.5 $Nm^3/hr./m^3$ or more, and Japanese Unexamined Patent Publication No. H8-253819 the method wherein Bi is diffused by controlling the amount of an applied annealing separator to 5 $g/m^2$ per one side. However, even by using any of the above methods, a required result cannot be obtained. This is presumably because a low melting point chemical compound is formed at the interface between a primary film and a substrate steel while Bi vapor is present between steel sheet layers.

With this in mind, the present inventors studied the method of tightening a primary film after Bi was removed from the interior of a steel so that Bi vapor might not reach the interface between the primary form and the substrate steel until Bi vapor between steel sheet layers was discharged outside the coil from between the layers in order to prevent a low melting point chemical compound from forming in combination with the primary film. Bi is removed from the interior of a steel at a temperature of over 1,000° C. and therefore the method of tightening a primary film at such a high temperature is considered. When a primary film is tightened before Bi is removed from the interior of a steel, Bi is not discharged into the space between steel sheet layers and incrassates at the interface between the primary final and the substrate steel. For this reason, it is important to remove Bi quickly and it is believed that rapid heating at decarburization annealing is effective from this viewpoint.

On the basis of the idea as mentioned above, the present inventors decided to use a chemical compound, such as $TiO_2$, which discharges oxygen gradually during finish annealing as a means for tightening a primary film in a high temperature range. It is believed that $TiO_2$ continues to discharge oxygen during the time when Bi is removed from the inside of a steel and during the time the steel is kept at a high temperature even after the removal, then the oxygen reacts to Si in the steel, but so doing $SiO_2$ is formed, the $SiO_2$ reacts to MgO in an anti-sticking agent, and thus forsterite is formed.

With regard to the blend of a Ti chemical compound to an annealing separator mainly composed of MgO in the case of a steel containing Bi, Japanese Unexamined Patent Publication No. 2000-96149 discloses the method wherein $SnO_2$, $Fe_2O_3$, $Fe_3O_4$ and $MoO_3$ are added and further $TiO_2$ is added by 1.0 to 15 as a part by weight. However, the blend of $SnO_2$ and the like makes a film dense in a low temperature range, and therefore prevents Bi from being removed from the interior of a steel, and accelerates the formation of a low melting point chemical compound combining with a primary film. Therefore, this method is undesirable.

On the basis of the above idea, the present inventors carried out an experiment wherein slabs for grain-oriented electrical steel sheets containing Bi and using MnS and AlN as inhibitors were used as the start materials, and subjected to heating, hot rolling, hot band annealing, a plurality of cold rollings with intermediate annealing interpolated in between to a finish product thickness, and primary recrystallization annealing or decarburization annealing up to 900° C. at a heating rate of 300° C./sec., preliminary annealing for 5 sec., further decarburization annealing, thereafter the application of an annealing separator while the Bi content, $TiO_2$ addition amount in the annealing separator and the coating amount thereof were varied. Thereafter, a secondary film was applied and burnt, then a specimen was cut out from the center of the width of a coil where a film was most likely to deteriorate, and film adhesiveness was evaluated.

Figure 6:
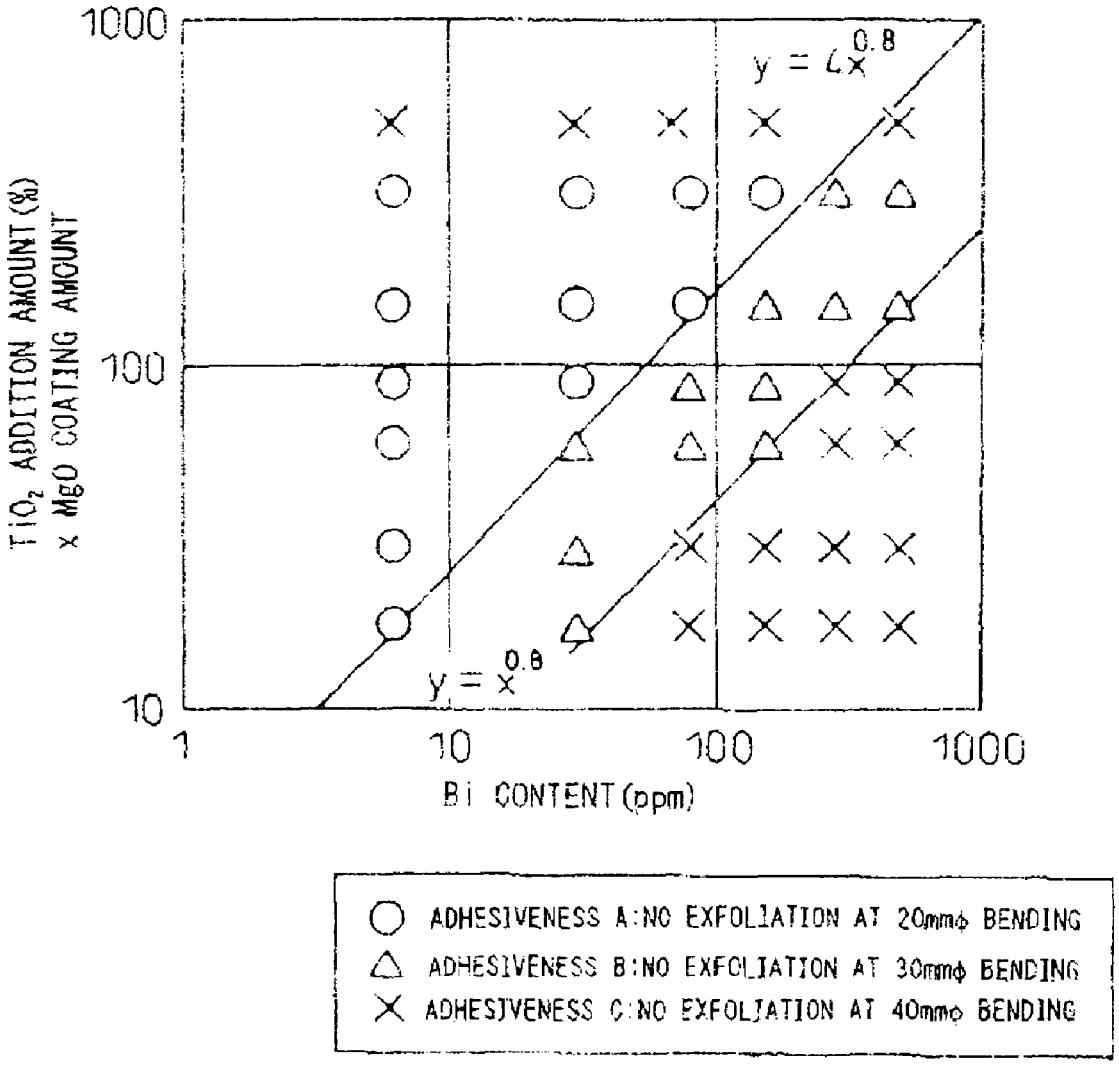
FIG. 6 is a graph showing the relationship among Bi content, the product of a $TiO_2$ addition amount and an MgO coating amount, and film adhesiveness.

FIG. 6 shows the relationship between the Bi amount in a steel and film adhesiveness. From this figure, it is understood that there is a correlation between the Bi content and film adhesiveness, and film adhesiveness of the level B or higher is obtained when the following expression is satisfied:

$$A^{0.8} \leqq B \times C \leqq 400 \quad (1),$$

and furthermore a truly excellent steel sheet having film adhesiveness of the level A is obtained when the following expression is satisfied;

$$4 \times A^{0.8} \leqq B \times C \leqq 400 \quad (2),$$

where A means the Bi content (ppm), B the $TiO_2$ amount added in relation to MgO of 100 as parts by weight, and C the amount per one side ($g/m^2$) of an applied annealing separator.

Since the product of the MgO coating amount and $TiO_2$ addition amount corresponds to the total amount of $TiO_2$ between steel sheet layers, as the product increases, the oxygen supply amount increases and a tighter primary film is formed. Therefore, in the case of a large Bi content, since Bi vapor remaining between steel sheet layers is abundant after Bi is removed from the interior of a steel, it is necessary to form a tighter primary film and to prevent deterioration of a primary film caused by Bi vapor and for that reason, it is necessary to increase the total amount of $TiO_2$. In the case of a small Bi content, since the amount of Bi vapor between steel sheet layers is small, even a small total amount of $TiO_2$ can suppress deterioration of a primary film.

Further, it is necessary to suppress the discharge of oxygen from $TiO_2$ until Bi is completely removed from the interior of a steel. Since the dissociative reaction of $TiO_2$ is believed to be the reaction expressed by $2TiO_2+4H_2+N_2 \rightarrow 2TiN+4H_2O$, it is also necessary to lower $P_{H2}$ and increase $P_{H2O}$ during finish annealing in order to delay the reaction of $TiO_2$.

Figure 7:
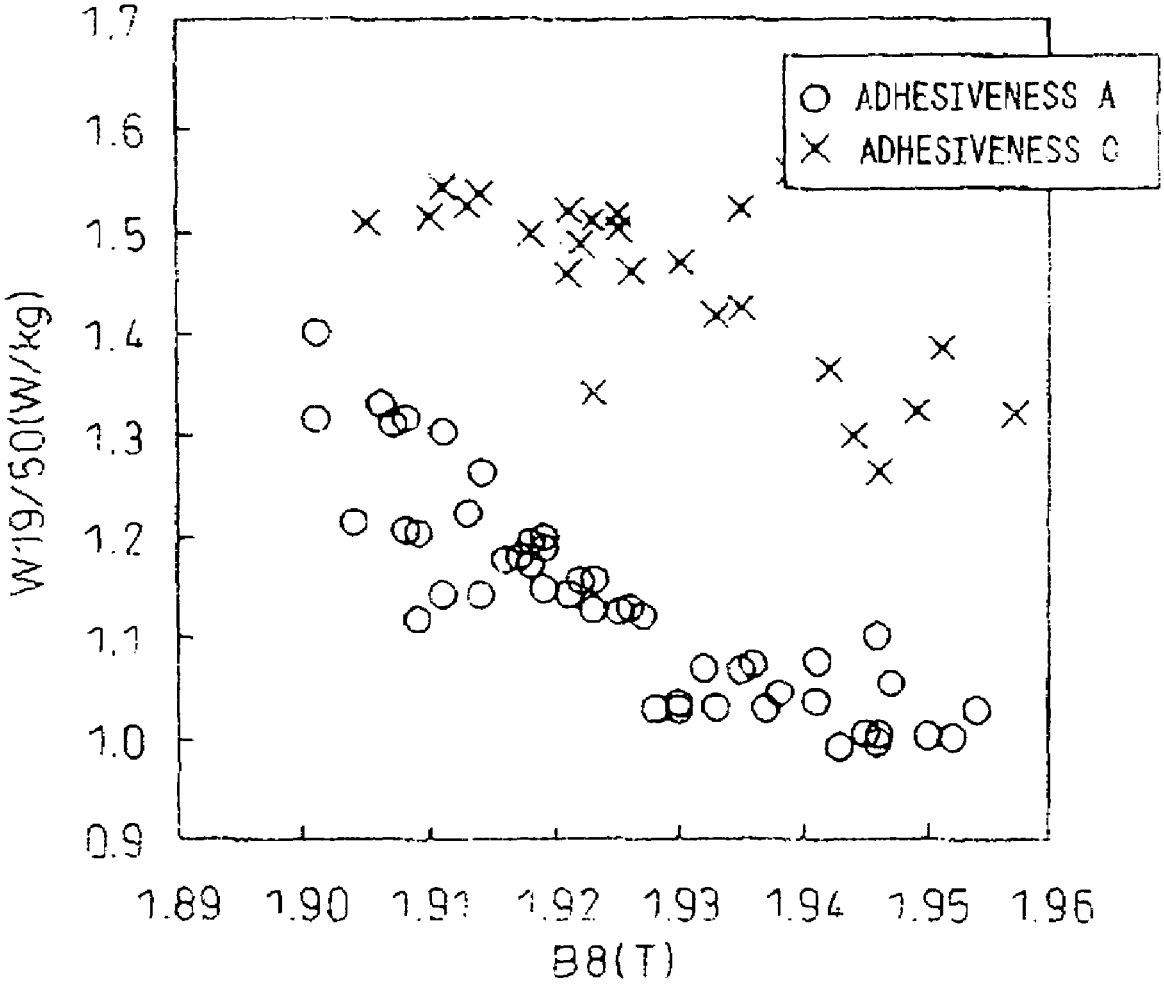
FIG. 7 is a graph showing the relationship among a magnetic flux density $B_8$, film adhesiveness, and high magnetic filed iron loss $W_{19/50}$.

FIG. 7 shows the relationship between a magnetic flux density $B_8$ and a high magnetic field iron loss ($W_{19/50}$) after forming grooves 15 μm in depth at intervals of 5 mm in the direction of 10 degrees to the direction right angles to the strip travelling direction and stress relief annealing were further carried out to the steel sheets having the levels A and C in adhesiveness. From the figure, it is understood that a steel sheet having better adhesiveness shows reduced iron loss at high magnetic flux density in comparison with a steel sheet having an identical magnetic flux density.

The reason for this is because, in the case of a raw material containing Bi, although iron loss decreases at high magnetic flux density, since secondarily recrystallized grains coarsen and thus magnetic domain widths expand, when a film has good adhesiveness, iron loss increases at high magnetic flux density since the film obtained after the application of a secondary film on the imposition of tension is tight and thus magnetic domains are refined.

The present inventors believe the reason why, in the case of a steel containing Bi, the adhesiveness of a primary film improves by increasing the heating rate at decarburization annealing or primary recrystallization annealing and by optimizing the amount of $TiO_2$ in relation to MgO of 100 as parts by weight and the amount of applied MgO.

Rapid heating at decarburization annealing makes it possible to control the amount of $SiO_2$ that constitutes a oxide film at an initial stage of decarburization, make the structure at the interface between a primary film and a substrate steel intricate during finish annealing, and accelerate the removal of Bi from the interior of a steel. Thereafter, the control of the total amount of $TiO_2$ between steel sheet layers based on the MgO coating amount and $TiO_2$ addition amount in accordance with the addition amount of Bi makes it possible to form a tight primary film and prevent deterioration of the primary film caused by Bi vapor between the steel sheet layers After decarburization annealing, an annealing separator composed mainly of MgO is applied to a steel sheet and dried. In this case, the $TiO_2$ amount added in relation to MgO of 100 as parts by weight and an MgO coating amount are controlled in accordance with the Bi amount so that the following expression (1) may be satisfied;

$$A^{0.8} \leqq B \times C \leqq 400 \quad (1),$$

or preferably the following expression (2) may be satisfied;

$$4 \times A^{0.8} \leqq B \times C \leqq 400 \quad (2),$$

where A means the Bi content (ppm), B the $TiO_2$ amount added in relation to MgO of 100 as parts by weight, and C the amount per one side ($g/m^2$) of an applied annealing separator.

In order to avoid an excessive amount of a primary film and decrease of a space factor, the product of the MgO coating amount and the $TiO_2$ addition amount is controlled to not more than 400 $g/m^2$×parts by weight. In contrast, in order to avoid deterioration of film adhesiveness, the product of the MgO coating amount and the $TiO_2$ addition amount is controlled to not less than raise to 0.8 power of the Bi content. The $TiO_2$ addition amount is controlled to 1 to 50 in relation to MgO of 100 as parts by weight. When the $TiO_2$ addition amount is not more than 1 as parts by weight, the MgO coating amount required for securing the necessary $TiO_2$ amount is very large and therefore the cost increases. On the other hand, when the $TiO_2$ addition amount exceeds 50 as parts by weight, the MgO ratio at a reaction interface lowers, and therefore the supply amount of MgO is insufficient, the formation of a primary film is insufficient, and resultantly adhesiveness deteriorates.

The MgO coating amount is controlled to 2 $g/m^2$ or more for securing the stability of the coating amount and to 15 $g/m^2$ or less from the viewpoint of cost and the stability of a coil shape at the time of coiling.

Further, final finish annealing is applied at 1,100° C. or higher for the purpose of primary film formation, secondary recrystallization and purification. In most cases, an insulation film is applied on a primary film after the finish annealing. In particular, an insulating film obtained by baking coating liquid composed mainly of phosphate and colloidal silica imposes a large tension on a steel sheet and is effective in more increase of iron loss.

Furthermore, an aforementioned grain-oriented electrical steel sheet may be subjected to so-called magnetic domain refinement treatment by laser irradiation, plasma irradiation, or groove forming with a gear roll of etching.

EXAMPLES

Example 1

Hot-rolled steel sheets 2.3 mm in thickness containing chemical components shown in Table 2 were annealed for 1 min. at 1,100° C. Thereafter, the steel sheets were cold rolled to produce cold-rolled steel sheets 0.22 mm in thickness.

Further, the produced strips were subjected to decarburization annealing under the conditions shown in Table 3 at the stages of heating and soaking. At that time, the steel sheets were heated to 850° C. at the heating rates shown in Table 3 and successively subjected to soaking treatment at 850° C.

Thereafter, the steel sheets were subjected to decarburization annealing at a constant temperature of 840° C. in wet hydrogen, coated with an annealing separator composed mainly of MgO, subsequently subjected to high temperature annealing for 20 hr. at 1,200° C. in a hydrogen gas atmosphere. The surplus MgO of the coated steel sheets was removed, insulating films composed mainly of colloidal silica and phosphate were formed on the formed forsterite films, and thus products were produced.

The ims made by CAMECAS was used to SIMS measurement. The measurement was carried out by irradiating the $^{16}O_2^-$ primary ion beam to the region 125 μm square at an accelerating voltage of 8 kV and an irradiation current of 110 nA under the condition where the mass resolution was adjusted to about 2,000.

The obtained properties are shown in Table 3. The coils E to J, which satisfy the conditions stipulated in the present invention, are grain oriented electrical steel sheets excellent in film and magnetic properties.

TABLE 2

| Chemical components (wt %) | | | | | | | |
|---|---|---|---|---|---|---|---|
| C | Si | Mn | P | S | sol. Al | N | Bi |
| 0.075 | 3.25 | 0.083 | 0.008 | 0.025 | 0.026 | 0.0084 | 0.0133 |

Example 2

Lasers were irradiated on the steel sheets F, G and H, which were excellent in film adhesiveness in Example 1, at intervals of 5 mm. The results are shown in Table 4.

As is clear from Table 4, since the steel sheets according to the present invention have very high magnetic flux densities, they can obtain an increased iron loss property, which has not so far been obtained by a conventional method, by the magnetic domains refinement.

TABLE 4

| Coil | Iron loss, $W_{17/50}$ (W/kg) | Iron loss, $W_{19/50}$ (W/kg) | Iron loss ratio, $W_{19/50}/W_{17/50}$ | Remarks |
|---|---|---|---|---|
| F | 0.69 | 1.13 | 1.64 | Invention example 2 |
| H | 0.63 | 0.95 | 1.51 | Invention example 1 |
| G | 0.77 | 1.3 | 1.69 | Comparative example |

Example 3

Slabs containing, in mass, 0.080% C, 3.30% Si, 0.080% Mn, 0.025% S, 0.026% acid-soluble Al, 0.0082% N, and respectively 0, 0.0030, 0.0150 and 0.0380% Bi were heated to 1,350° C., thereafter hot rolled to a thickness of 2.3 mm, and annealed for 1 min. at temperatures of 1,000° C., 1,070° C., 1,140° C. and 1,210° C., respectively. Thereafter, the steel sheets were cold rolled to a final thickness of 0.22 mm.

Further, when the product strips were subjected to decarburization annealing, the strips were heated to 850° C. at a heating rate of 400° C./sec. in a temperature range from 300° C. to 850° C., immediately thereafter, subjected to prelimi-

TABLE 3

| | Heating | Soaking after heating | | Product properties | | | | | | |
|---|---|---|---|---|---|---|---|---|---|---|
| | | | | Bi concentration at interface | | Magnetic | | | | |
| Coil | zone Heating rate (° C./sec.) | Preliminary annealing time (sec.) | $PH_2O$ | between substrate steel and primary film (ppm) | Poor film adhesiveness rate (%) | flux density $B_8$ (T) | Iron loss, $W_{17/50}$ (W/kg) | Iron loss, $W_{19/50}$ (W/kg) | Iron loss ratio, $W_{19/50}/W_{17/50}$ | Remarks |
| A | 20 | 5 | $4 \times 10^{-2}$ | 8500 | 80 | 1.884 | 1.122 | 2.291 | 2.04 | Comparative example |
| B | 80 | 5 | $4 \times 10^{-2}$ | 3300 | 50 | 1.954 | 1.058 | 1.623 | 1.53 | Comparative example |
| C | 400 | 0.5 | $4 \times 10^{-2}$ | 2800 | 30 | 1.961 | 1.010 | 1.441 | 1.43 | Comparative example |
| D | 400 | 5 | $5 \times 10^{-5}$ | 1200 | 25 | 1.968 | 0.986 | 1.343 | 1.36 | Comparative example |
| E | 400 | 15 | $4 \times 10^{-2}$ | 5 | 0 | 1.968 | 0.906 | 1.306 | 1.44 | Invention example |
| F | 400 | 5 | $5 \times 10^{-1}$ | 0.08 | 0 | 1.949 | 0.924 | 1.554 | 1.68 | Invention example |
| G | 400 | 5 | $1 \times 10^{-1}$ | 0.3 | 0 | 1.945 | 0.781 | 1.363 | 1.75 | Invention example |
| H | 400 | 5 | $4 \times 10^{-2}$ | 21 | 0 | 1.984 | 0.840 | 1.256 | 1.50 | Invention example |
| I | 400 | 5 | $6 \times 10^{-9}$ | 95 | 0 | 1.958 | 0.917 | 1.581 | 1.72 | Invention example |
| J | 400 | 5 | $3 \times 10^{-9}$ | 420 | 0 | 1.955 | 0.798 | 1.401 | 1.76 | Invention example |
| K | 400 | 5 | $7 \times 10^{-1}$ | 0.002 | 0 | 1.928 | 0.830 | 1.630 | 1.96 | Comparative example |
| L | 400 | 30 | $4 \times 10^{-2}$ | 0.005 | 0 | 1.933 | 0.818 | 1.543 | 3.89 | Comparative example |

nary annealing for 5 sec. at 850° C. in an atmosphere having the ratio $P_{H2O}/P_{H2}$ of 0.8, and further subjected to decarburization annealing at a constant temperature of 840° C. in wet hydrogen.

Thereafter, the steel sheets were coated with an annealing separator composed mainly of MgO; and subjected to high temperature annealing for 20 hr. at the maximum attaining temperature of 1,230° C. in a hydrogen gas atmosphere. The surplus MgO on the steel sheets was removed, insulating films composed mainly of colloidal silica and phosphate were formed on the formed forsterite films, and resultantly the products were produced. Thereafter, the steel sheets were subjected to magnetic domain refinement treatment by laser irradiation. The laser irradiation conditions were the irradiation row intervals of 6.5 mm, irradiation spot intervals of 0.6 mm and irradiation energy of 0.8 mJ/mm$^2$. The production conditions and the magnetic properties in these cases are shown in Table 5.

The coils produced under the conditions satisfying the requirements stipulated in the present invention are grain-oriented electrical steel sheets having excellent in iron loss property.

TABLE 5

| Bi content (ppm) | Annealing temperature before finish cold rolling (° C.) | $B_8$ T | $W_{17/50}$ W/kg | $W_{19/50}$ W/kg | Remarks |
|---|---|---|---|---|---|
| 0 | 1000 | 1.835 | 0.835 | 1.48 | Conventional method |
| 0 | 1070 | 1.901 | 0.785 | 1.25 | Conventional method |
| 0 | 1140 | 1.923 | 0.732 | 1.21 | Conventional method |
| 0 | 1210 | 1.765 | 1.205 | 2.19 | Conventional method |
| 30 | 1000 | 1.913 | 0.792 | 1.31 | Comparative example |
| 30 | 1070 | 1.942 | 0.682 | 1.10 | Invention example 2 |
| 30 | 1140 | 1.968 | 0.643 | 0.96 | Invention example 1 |
| 30 | 1210 | 1.758 | 1.221 | 2.25 | Comparative example |
| 150 | 1000 | 1.919 | 0.772 | 1.35 | Comparative example |
| 150 | 1070 | 1.944 | 0.692 | 1.11 | Invention example 2 |
| 150 | 1140 | 1.958 | 0.658 | 1.02 | Invention example 1 |
| 150 | 1210 | 1.652 | 1.548 | Unmeasurable | Comparative example |
| 380 | 1000 | 1.923 | 0.753 | 1.31 | Comparative example |
| 380 | 1070 | 1.945 | 0.690 | 1.13 | Invention example 2 |
| 380 | 1140 | 1.971 | 0.638 | 0.94 | Invention example 1 |
| 380 | 1210 | 1.621 | 1.603 | Unmeasurable | Comparative example |

Example 4

Slabs containing, in mass, 0.075% C, 3.35% Si, 0.080% Mn, 0.025% S, 0.025% acid-soluble Al, 0.085% N, 0.0140% Sn, 0.08% Cu, and respectively 0.0015 and 0.0230% Bi were heated to 1,350° C., and immediately thereafter hot rolled to hot-rolled coils 2.4 mm in thickness. The hot-rolled coils were cold rolled to a thickness of 1.8 mm and then annealed for 1 min. at temperatures of 1,050° C., 1,150° C. and 1,250° C., respectively. Thereafter, the coils were cold rolled to a final thickness of 0.22 mm. Then, the cold-rolled coils were subjected to treatment similarly to Example 1. The production conditions and the magnetic properties of the product coils are shown in Table 6.

TABLE 6

| Coil No. | Bi content (ppm) | Annealing temperature before finish cold rolling (° C.) | $B_6$ T | Remarks |
|---|---|---|---|---|
| A1 | 15 | 1050 | 1.908 | Comparative example |
| A2 | 15 | 1150 | 1.953 | Invention example 1 |
| A3 | 15 | 1250 | 1.852 | Comparative example |
| B1 | 230 | 1050 | 1.942 | Invention example 2 |
| B2 | 230 | 1150 | 1.968 | Invention example 1 |
| B3 | 230 | 1250 | 1.663 | Comparative example |

Example 5

Magnetic domain refinement treatment was applied to the coils A1, A2, B1 and B2 produced in Example 4 by forming grooves 15 μm in depth and 90 μm in width at intervals of 5 mm in the direction of 12 degrees to the direction forming right angles to the strip traveling direction. The iron loss values before and after the magnetic domain refinement treatment are shown in Table 7. The coils produced under the conditions satisfying the requirements stipulated in the present invention are grain-oriented electrical steel sheets having excellent in iron loss property.

TABLE 7

| | Iron loss value before magnetic domain control | | Iron loss value after magnetic domain control | | |
|---|---|---|---|---|---|
| | $W_{17/50}$ W/kg | $W_{19/50}$ W/kg | $W_{17/50}$ W/kg | $W_{19/50}$ W/kg | Remarks |
| A1 | 0.99 | 1.68 | 0.79 | 1.26 | Comparative example |
| A2 | 0.83 | 1.41 | 0.67 | 1.11 | Invention example 1 |
| B1 | 0.88 | 1.47 | 0.70 | 1.18 | Invention example 2 |
| B2 | 0.82 | 1.35 | 0.64 | 0.99 | Invention example 1 |

Example 6

Slabs containing, in mass, 0.070% C, 3.25% Si, 0.070% Mn, 0.018% Se, 0.025% acid-soluble Al, 0.0084% N, 0.025% Sb, 0.014% Mo, and 0.035% Bi were heated to 1,400° C., and immediately thereafter hot rolled to hot-rolled coils 2.5 mm in thickness. The hot-rolled steel sheets were annealed at 1,000° C., then cold rolled to a thickness of 1.7 mm, and then annealed for 1 min. at temperatures of 1,000° C., 1,050° C., 1,100° C., 1,150° C., and 1,200° C. respectively. Thereafter, the cold-rolled coils were further cold rolled to a final thickness of 0.22 mm. Then, the coils were subjected to treatment similarly to Example 4. The production conditions and the magnetic properties of the product coils are shown in Table 8.

The coils produced under the conditions satisfying the requirements stipulated in the present invention are the grain-oriented electrical steel sheets having excellent in iron loss property.

TABLE 8

| Coil No. | Bi content (ppm) | Annealing temperature before finish cold rolling (° C.) | $B_8$ T | Remarks |
|---|---|---|---|---|
| A1 | 350 | 1000 | 1.895 | Comparative example |
| A2 | 350 | 1050 | 1.945 | Invention example 2 |
| A3 | 350 | 1100 | 1.952 | Invention example 1 |
| B1 | 350 | 1150 | 1.963 | Invention example 1 |
| B2 | 350 | 1200 | 1.753 | Comparative example |

Example 7

Slabs containing, in mass, 0.075% C, 3.22% Si, 0.080% Mn, 0.025% S, 0.026% acid-soluble Al, 0.0085% N, and 0.0060% Bi were heated to 1,350° C., immediately thereafter hot rolled to a thickness of 2.3 mm, and annealed for 1 min. at 1,100° C. Thereafter, the steel sheets were cold rolled to a final thickness of 0.22 mm.

Further, when the produced strips were subjected to decarburization annealing, the strips were heated to 850° C. at a heating rate of 300° C./sec. in a temperature range from 300° C. to 850° C., and then subjected to decarburization annealing at a constant temperature of 840° C. in wet hydrogen. Thereafter, the strips were coated with an annealing separator of 8 g/m$^2$ per one side, the annealing separator containing $TiO_2$ of 15 in relation to MgO of 100 as parts by weight, and subjected to high temperature annealing for 20 hr. at the maximum arrival temperature of 1,200° C. in a hydrogen gas atmosphere. The surplus MgO on the produced steel sheets was removed, insulating films composed mainly of colloidal silica and phosphate were formed on the formed forsterite films, and resultantly the products were produced. The products obtained through the above processes showed good film adhesiveness (in the evaluation at the center portion of the width of a coil) to the extent of generating no film exfoliation even when the products were bent along a round bar 30 mm in diameter and also good magnetic properties of 1.95 T in magnetic flux density.

Example 8

Slabs containing, in mass, 0.075% C, 3.25% Si, 0.083% Mn, 0.025% S, 0.026% acid-soluble Al, 0.0085% N, and 0.0060% Bi were heated to 1,350° C., then hot rolled to a thickness of 2.3 mm, and annealed for 1 min. at 1,100° C. Thereafter, the steel sheets were cold rolled to a final thickness of 0.22 mm.

Further, when the produced strips were subjected to decarburization annealing, the strips were heated to 850° C. at the heating rates of 20 and 300° C./sec., respectively in a temperature range from 300° C. to 850° C., then subjected to preliminary annealing for 0.5, 10 and 30 sec., respectively at 850° C., and subsequently subjected to decarburization annealing at a constant temperature of 840° C. in wet hydrogen. Thereafter, the strips were coated with an annealing separator of 8 g/m$^2$ per one side, the annealing separator containing $TiO_2$ of 15 in relation to MgO of 100 as parts by weight, and subjected to high temperature annealing for 20 hr. at the maximum attaining temperature of 1,200° C. in a hydrogen gas atmosphere. The surplus MgO on the produced steel sheets was removed, insulating films composed mainly of colloidal silica and phosphate were formed on the formed forsterite films, and resultantly the products were produced. The film adhesiveness was evaluated at the center portion of the width of a coil, and a case where no film exfoliation appeared even when a product was bent along the surface of a round bar 20 mm in diameter was classified as A, a case where no film exfoliation appeared even when a product was bent along the surface of a round bar 30 mm in diameter as B, a case where film exfoliation appeared when a product was bent along the surface of a round bar 30 mm in diameter as C, and a case where exfoliation appeared when a coil was unwound as D. As shown in Table 9, the coils produced under the conditions satisfying the requirements stipulated in the present invention are grain-oriented electrical steel sheets excellent in film and magnetic properties.

TABLE 9

| Heating rate (° C./sec.) | Soaking time (sec.) | Residual C (ppm) | $TiO_2$ addition amount as parts by weight | Film adhesiveness | $B_8$ (T) | Remarks |
|---|---|---|---|---|---|---|
| 20 | 0.5 | 9 | 5 | D | 1.948 | Comparative example |
| | | | 15 | D | 1.938 | Comparative example |
| 20 | 10 | 13 | 5 | D | 1.934 | Comparative example |
| | | | 15 | D | 1.944 | Comparative example |
| 20 | 30 | 12 | 5 | D | 1.958 | Comparative example |
| | | | 15 | D | 1.933 | Comparative example |
| 300 | 0.5 | 12 | 5 | C | 1.948 | Comparative example |
| | | | 15 | C | 1.944 | Comparative example |
| 300 | 10 | 14 | 5 | B | 1.955 | Invention example |
| | | | 15 | A | 1.962 | Invention example |
| 300 | 30.0 | 42 | 5 | B | 1.948 | Comparative example |
| | | | 15 | A | 1.952 | Comparative example |

Example 9

Slabs containing, in mass, 0.078% C, 3.35% Si, 0.090% Mn, 0.025% S, 0.028% acid-soluble Al, 0.0084% N, 0.14% Sn, 0.10% Cu, and respectively 0.0007, 0.0080 and 0.0380% Bi were heated to 1,360° C., then hot rolled to a thickness of 2.0 mm, and annealed for 1 min. at 1,080° C. Thereafter, the steel sheets were cold rolled to a final thickness of 0.22 mm. When the produced strips were subjected to decarburization annealing, the strips were heated to 850° C. at a heating rate of 400° C./sec. in a temperature range from 300° C. to 850° C., then subjected to preliminary annealing for 10 sec. at 830° C., and subsequently subjected to decarburization annealing at a constant temperature of 840° C. in wet hydrogen. Thereafter, the strips were coated with an annealing separator of respectively 4 and 10 g/m$^2$ per one side, the annealing separator containing $TiO_2$ of 3, 15 and 30 respectively in relation to MgO of 100 as parts by weight, and subjected to high temperature annealing for 20 hr. at the maximum attaining temperature of 1,200° C. in a hydrogen gas atmosphere. The surplus MgO on the produced steel sheets was removed, insulating films composed mainly of colloidal silica and phosphate were formed on the formed forsterite films, and resultantly the products were produced. The film adhesiveness was evaluated at the center portion of the width of a coil. As shown in Table 10, the coils produced under the conditions satisfying the requirements stipulated in the present invention are the grain-oriented electrical steel sheets excellent in film and magnetic properties.

TABLE 10

| Coil No. | Bi content (ppm) | $TiO_2$ addition amount as parts by weight | Coating amount per one side ($g/m^2$) | Film adhesiveness | $B_8$ T | Remarks |
|---|---|---|---|---|---|---|
| A1 | 7 | 3 | 4 | B | 1.942 | Invention example |
| A2 | 7 | 15 | 4 | A | 1.955 | Invention example |
| A3 | 7 | 30 | 4 | A | 1.948 | Invention example |
| A4 | 7 | 3 | 10 | A | 1.949 | Invention example |
| A5 | 7 | 15 | 10 | A | 1.954 | Invention example |
| A6 | 7 | 30 | 10 | A | 1.944 | Invention example |
| B1 | 80 | 3 | 4 | C | 1.953 | Comparative example |
| B2 | 80 | 15 | 4 | B | 1.955 | Invention example |
| B3 | 80 | 30 | 4 | B | 1.968 | Invention example |
| B4 | 80 | 3 | 10 | C | 1.972 | Comparative example |
| B5 | 80 | 15 | 10 | A | 1.966 | Invention example |
| B6 | 80 | 30 | 10 | A | 1.948 | Invention example |
| C1 | 380 | 3 | 4 | C | 1.955 | Comparative example |
| C2 | 380 | 15 | 4 | C | 1.966 | Comparative example |
| C3 | 380 | 30 | 4 | B | 1.971 | Invention example |
| C4 | 380 | 3 | 10 | C | 1.961 | Comparative example |
| C5 | 380 | 15 | 10 | B | 1.949 | Invention example |
| C6 | 380 | 30 | 10 | B | 1.953 | Invention example |

Example 10

The coils A3, B1, B3 and B5 produced in Example 9 were subjected to magnetic domain refinement treatment by laser irradiation. The laser irradiation conditions were irradiation row intervals of 6.5 mm, irradiation spot intervals of 0.6 mm and irradiation energy of 0.8 $mJ/mm^2$. The values of $W_{17/50}$ before and after the magnetic domain refinement treatment are shown in Table 11. The coils produced under the conditions satisfying the requirements stipulated in the present invention are the grain-oriented electrical steel sheets having excellent in iron loss property.

TABLE 11

| | Iron loss value before magnetic domain control | | Iron loss value after magnetic domain control | | |
|---|---|---|---|---|---|
| | $W_{17/50}$ (W/kg) | $W_{19/50}$ (W/kg) | $W_{17/50}$ (W/kg) | $W_{19/50}$ (W/kg) | Remarks |
| A3 | 0.81 | 1.40 | 0.70 | 0.99 | Invention example |
| B1 | 0.99 | 1.59 | 0.77 | 1.35 | Comparative example |
| B3 | 0.90 | 1.49 | 0.69 | 1.10 | Invention example |
| B5 | 0.85 | 1.41 | 0.64 | 0.95 | Invention example |

Example 11

Slabs containing, in mass, 0.075% C, 3.22% Si, 0.080% Mn, 0.027%, 0.025% acid-soluble Al, 0.0084% N, 0.11% Sn, 0.08% Cu, and 0.0080% Bi were heated to 1,360° C., then hot rolled to a thickness of 2.2 mm, and annealed for 1 min. at 1,120° C. Thereafter, the steel sheets were cold rolled to a final thickness of 0.22 mm. When the produced strips were subjected to decarburization annealing, the strips were heated to 850° C. at a heating rate of 400° C./sec. in a temperature range from 300° C. to 850° C., then subjected to preliminary annealing for 5 sec. at 850° C., and subsequently subjected to decarburization annealing at a constant temperature of 840° C. in wet hydrogen. Thereafter, the strips were coated with an annealing separator of respectively 4 and 14 $g/m^2$ per one side, the annealing separator containing $TiO_2$ of 3, 10, 30 and 50 respectively in relation to MgO of 100 as parts by weight, and subjected to high temperature annealing for 20 hr. at the maximum attaining temperature of 1,200° C. in a hydrogen gas atmosphere. The surplus MgO on the produced steel sheets was removed, insulating films composed mainly on colloidal silica and phosphate were formed on the formed forsterite films, and resultantly the products were produced. The film adhesiveness was evaluated at the center portion of the width of a coil. As shown in Table 12, the coils produced under the conditions satisfying the requirements stipulated in the present invention are grain-oriented electrical steel sheets excellent in film and magnetic properties.

TABLE 12

| Coil No. | $TiO_2$ addition amount as parts by weight | Coating amount per one side ($g/m^2$) | Film adhesiveness | Space factor (%) | $B_8$ T | Remarks |
|---|---|---|---|---|---|---|
| D1 | 3 | 4 | C | 97.2 | 1.958 | Comparative example |
| D2 | 10 | 4 | B | 97.4 | 1.955 | Invention example |
| D3 | 30 | 4 | A | 97.1 | 1.961 | Invention example |
| D4 | 50 | 4 | C | 96.9 | 1.949 | Comparative example |
| D5 | 3 | 14 | B | 97.2 | 1.948 | Invention example |
| D6 | 10 | 14 | A | 97.1 | 1.966 | Invention example |
| D7 | 30 | 14 | C | 96.2 | 1.954 | Comparative example |
| D8 | 50 | 14 | C | 94.5 | 1.944 | Comparative example |

Example 12

Magnetic domain refinement treatment was carried out to the coils D1, D2 and D3 produced in Example 11 by groove forming with a gear roll. The iron loss values before and after the magnetic domain refinement by forming grooves 15 μm in depth and 90 μm in width at intervals of 5 mm in the direction of 12 degrees to the direction forming right angles to the strip traveling direction are shown in Table 13. The coils D2 and D3 produced under the conditions stipulated in the present invention are grain-oriented electrical steel sheets having excellent in iron loss property.

TABLE 13

| | Iron loss value before magnetic domain control | | Iron loss value after magnetic domain control | | |
|---|---|---|---|---|---|
| | $W_{17/50}$ (W/kg) | $W_{19/50}$ (W/kg) | $W_{17/50}$ (W/kg) | $W_{19/50}$ (W/kg) | Remarks |
| D1 | 0.92 | 1.55 | 0.76 | 1.41 | Comparative example |
| D2 | 0.88 | 1.45 | 0.68 | 1.05 | Invention example |
| D3 | 0.82 | 1.41 | 0.63 | 0.99 | Invention example |

INDUSTRIAL APPLICABILITY

The present invention makes it possible to provide: a Bi-containing grain-oriented electrical steel sheet having good magnetic properties, especially excellent in iron loss at high magnetic flux density and film properties; and a method for producing such a grain-oriented electrical steel sheet.

The invention claimed is:

1. An ultra-high magnetic flux density grain-oriented electrical steel sheet excellent in iron loss at high magnetic flux density and film properties, said grain-oriented electrical steel sheet containing 2 to 7% Si in mass as an indispensable component, characterized in that Bi exists at the interface between the substrate steel and a primary film on the substrate steel and wherein the substrate steel does not contain Bi.

2. An ultra-high magnetic flux density grain-oriented electrical steel sheet excellent in iron loss at high magnetic flux density and film properties, said grain-oriented electrical steel sheet containing 2 to 7% Si in mass as an indispensable component, characterized in that Bi is present at 0.01 to less than 1,000 ppm in weight at the interface between the substrate steel and a primary film on the substrate steel and wherein the substrate steel does not contain Bi.

3. An ultra-high magnetic flux density grain-oriented electrical steel sheet excellent in iron loss at high magnetic flux density and film properties, said grain-oriented electrical steel sheet containing 2 to 7% Si in mass as an indispensable component, characterized in that Bi is present at 0.1 to less than 100 ppm in weight at the interface between the substrate steel and a primary film on the substrate steel and wherein the substrate steel does not contain Bi.

4. An ultra-high magnetic flux density grain-oriented electrical steel sheet excellent in iron loss at high magnetic flux density and film properties according to claim 1, characterized by having a high magnetic flux density $B_8$ of 1.94 T or more.

5. An ultra-high magnetic flux density grain-oriented electrical steel sheet excellent in iron loss at high magnetic flux density and film properties according to claim 1, characterized in that the ratio of $W_{19/50}$ to $W_{b\ 17/50}$ is less than 1.8, where $W_{19/50}$ represents an energy loss under the excitation conditions of 1.9 T in B8 and 50 Hz and $W_{17/50}$ the same under the excitation conditions of 1.7 T in $B_8$ and 50 Hz.

6. An ultra-high magnetic flux density grain-oriented electrical steel sheet excellent in iron loss at high magnetic flux density and film properties according to claim 1, characterized by showing such low degradation in a high magnetic flux density that the ratio of $W_{19/50}$ to $W_{17/50}$ is less than 1.6 after said electrical steel sheet has been subjected to magnetic domain refinement treatment.

7. An ultra-high magnetic flux density grain-oriented electrical steel sheet excellent in iron loss at high magnetic flux density and film properties according to claim 1, characterized by excellent in iron loss at a high magnetic flux density that $W_{19/50}$ is not more than 1.2 W/kg after said electrical steel sheet has been subjected to magnetic domain refinement treatment.

* * * * *